US011373617B2

(12) United States Patent
Yamagishi

(10) Patent No.: US 11,373,617 B2
(45) Date of Patent: Jun. 28, 2022

(54) DISPLAY DEVICE

(71) Applicant: Japan Display Inc., Minato-ku (JP)

(72) Inventor: Yasuhiko Yamagishi, Tokyo (JP)

(73) Assignee: Japan Display Inc., Minato-ku (JP)

( * ) Notice: Subject to any disclaimer, the term of this patent is extended or adjusted under 35 U.S.C. 154(b) by 0 days.

(21) Appl. No.: 17/035,834

(22) Filed: Sep. 29, 2020

(65) Prior Publication Data

US 2021/0012744 A1 Jan. 14, 2021

Related U.S. Application Data

(63) Continuation of application No. 16/659,781, filed on Oct. 22, 2019, now Pat. No. 10,839,768, which is a continuation of application No. 15/185,921, filed on Jun. 17, 2016, now Pat. No. 10,497,332.

(30) Foreign Application Priority Data

Jul. 6, 2015 (JP) ..... 2015-135273

(51) Int. Cl.
*G09G 3/36* (2006.01)

(52) U.S. Cl.
CPC ..... *G09G 3/3696* (2013.01); *G09G 3/3685* (2013.01); *G09G 2300/0426* (2013.01); *G09G 2320/0233* (2013.01)

(58) Field of Classification Search
CPC ..... G09G 3/3696; G09G 3/3685; G09G 2300/0426; G09G 2320/0233
See application file for complete search history.

(56) References Cited

U.S. PATENT DOCUMENTS 5,598,180 A * 1/1997 Suzuki ..... G09G 3/3688 345/96
2005/0052439 A1* 3/2005 Liou ..... G09G 3/20 345/204
2005/0264548 A1* 12/2005 Okamura ..... G09G 3/3688 345/204
2006/0119706 A1 6/2006 An
2007/0247409 A1 10/2007 Nishimura et al.
(Continued)

FOREIGN PATENT DOCUMENTS

JP 10-239655 9/1998
JP 3110339 11/2000
(Continued)

OTHER PUBLICATIONS

Office Action dated Dec. 4, 2018 in Japanese Patent Application No. 2015-135273 6 pages (with unedited computer generated English translation provided by Global Dossier).

*Primary Examiner* — Benyam Ketema
(74) *Attorney, Agent, or Firm* — Oblon, McClelland, Maier & Neustadt, L.L.P.

(57) ABSTRACT

According to one embodiment, a display device, includes a display panel which includes divided display areas, signal line drivers, circuit boards which include a master board, power supply circuits, gradation voltage generation circuits, and at least one connection line, all the gradation voltage generation circuits generating the gradation voltages corresponding to a reference voltage supplied from the power supply circuit provided on the master board.

13 Claims, 15 Drawing Sheets

(56) References Cited

U.S. PATENT DOCUMENTS

2009/0021507 A1* 1/2009 Bae ..... G09G 3/3666 345/212
2009/0073154 A1* 3/2009 Lee ..... G09G 3/3666 345/211
2010/0013869 A1* 1/2010 Matsumoto ..... G09G 3/3666 345/690
2010/0141850 A1* 6/2010 Itoh ..... G09G 3/3677 348/731
2010/0231810 A1 9/2010 Itoh
2010/0265224 A1* 10/2010 Cok ..... B32B 37/24 345/206
2011/0148825 A1* 6/2011 Ueno ..... G09G 3/006 345/204
2012/0140160 A1* 6/2012 Han ..... G02F 1/13336 349/144
2014/0085279 A1 3/2014 Shiomi
2015/0187321 A1* 7/2015 Kim ..... G09G 3/3685 345/87
2015/0243208 A1* 8/2015 Kim ..... G09G 3/3225 345/204
2015/0243212 A1 8/2015 Lee
2015/0348492 A1 12/2015 Park
2015/0348792 A1* 12/2015 Lee ..... H01L 21/32137 438/714
2016/0019846 A1 1/2016 Kim
2016/0189655 A1* 6/2016 Choi ..... G09G 3/3674 345/215

FOREIGN PATENT DOCUMENTS

JP 2007-286525 11/2007
JP 2010-26138 A 2/2010
JP WO 2012157728 * 5/2012 ..... G09G 3/36
WO WO 2012/157728 A1 11/2012

* cited by examiner

DISPLAY DEVICE

CROSS-REFERENCE TO RELATED APPLICATIONS

This application is a continuation of and claims the benefit of priority under 35 U.S.C. § 120 from U.S. application Ser. No. 16/659,781 filed Oct. 22, 2019, which is a continuation of U.S. application Ser. No. 15/185,921 filed Jun. 17, 2016 (now U.S. Pat. No. 10,497,332 issued Dec. 3, 2019), and claims the benefit of priority under 35 U.S.C. § 119 from Japanese Patent Application No. 2015-135273 filed Jul. 6, 2015, the entire contents of each of which are incorporated herein by reference.

FIELD

Embodiments described herein relate generally to a display device.

BACKGROUND

In display devices, the time to write a video signal to each pixel becomes gradually short because of the increase in display definition. To assure the write time sufficiently, the high-definition display device displays the image by, for example, a divisional drive system of driving divided display areas, separately and simultaneously, by drivers corresponding to the respective areas.

The display device of the divisional drive system has a risk that difference in luminance or non-uniformity in display may occur between the divided display areas if a potential difference is exist between reference voltages to generate gradation voltages in respective signal line drivers.

DETAILED DESCRIPTION

Figure 1:
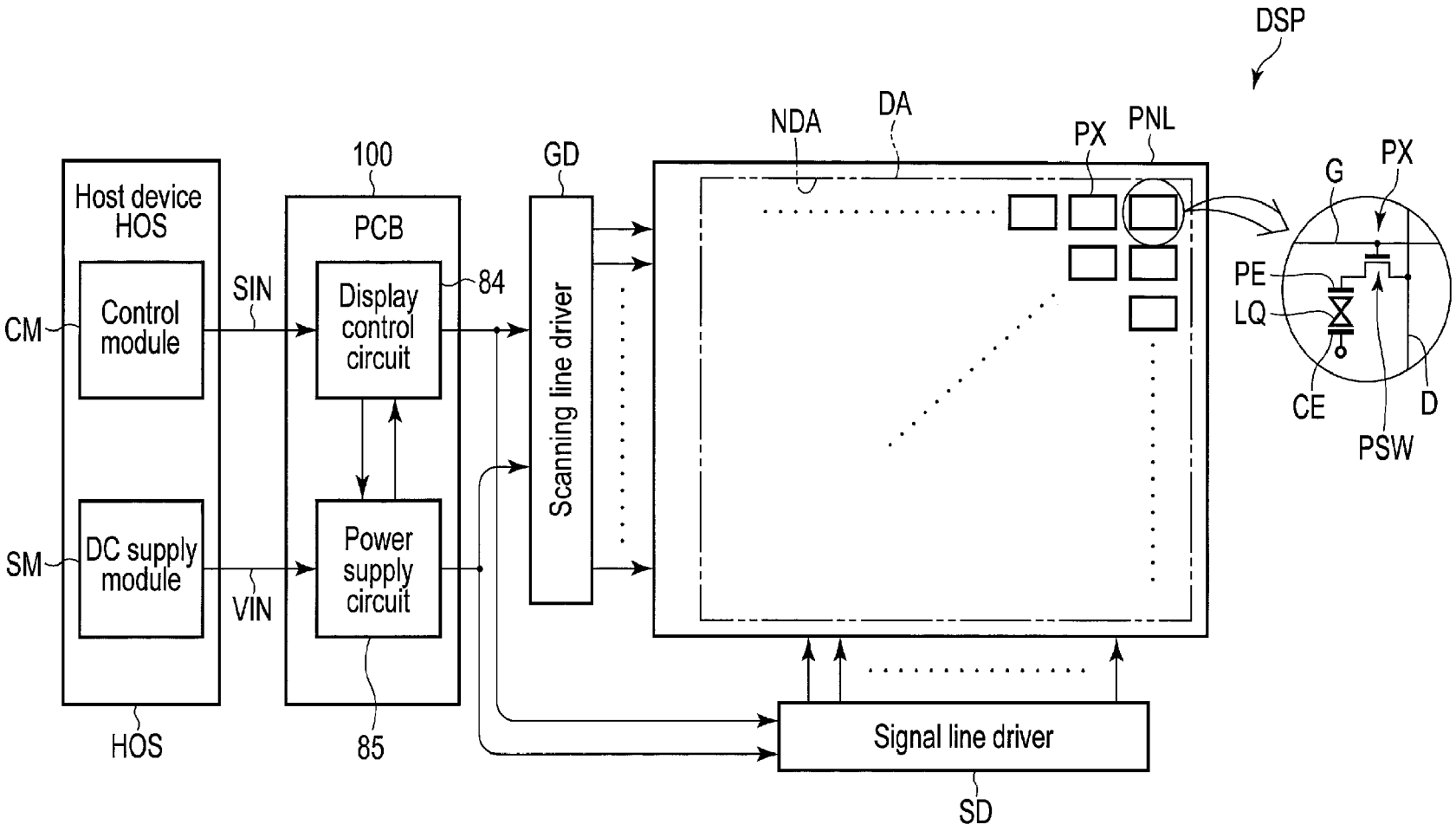
FIG. 1 is a block diagram showing a summary of a system of driving a display device.

In general, according to one embodiment, a display device, comprising: a display panel which includes divided display areas and allows an image to be displayed in a display area surrounded by a non-display area; signal line drivers which supply corresponding data signals to the divided display areas, respectively; circuit boards which include a master board and supply gradation voltages for generation of the data signals to the signal line drivers; a power supply circuit provided on each of the circuit boards; a gradation voltage generation circuit provided on each of the circuit boards and connected to the power supply circuit; and at least one connection line which connects the circuit boards to each other, all the gradation voltage generation circuits generating the gradation voltages corresponding to a reference voltage supplied from the power supply circuit provided on the master board.

According to another embodiment, a display device, comprising: a display panel which includes divided display areas and allows an image to be displayed in a display area surrounded by a non-display area; signal line drivers which are arranged in the non-display area, include a master driver, and supply corresponding data signals to the divided display areas, respectively; gradation voltage generation circuits each provided on each of the signal line drivers; power supply circuits each connected to an end of each of the gradation voltage generation circuits; nodes each existing on each circuit connecting each of the power supply circuits and each of the ends; and a connection line which connects the nodes to each other, the power supply circuit provided on the master driver supplying a reference voltage to all the ends, the gradation voltage generation circuits generating gradation voltages based on the reference voltage.

Embodiments will be described with reference to accompanying drawings. The disclosure is merely an example, and proper changes within the spirit of the invention, which can easily be conceived by a person of ordinary skill in the art, naturally fall within the scope of invention. In addition, in some cases, in order to make the description clearer, the widths, thicknesses, shapes and the like of the respective parts are schematically illustrated in the drawings, as compared to the actual modes. However, the schematic illustration is merely an example, and adds no restrictions to the interpretation of the invention. Furthermore, in the specification and drawings, constituent elements having the same or similar functions as those described in connection with preceding drawings are denoted by like reference numerals and duplicated detailed explanations may be arbitrarily omitted.

FIG. 1 is a block diagram showing a summary of a driving system of a display device.

The display device DSP comprises a host device HOS, a circuit board (PCB) 100, a scanning line driver GD, a signal line driver SD, and a display panel PNL. The host device HOS comprises a control module CM and a direct-current voltage (DC) supply module SM, and the circuit board 100 includes a display control circuit 84 and a power supply circuit 85. The display panel PNL is, for example, a liquid crystal display panel including pixels PX arrayed in a matrix in a display area DA in which an image is displayed. In the example illustrated, the display panel PNL includes a scanning line G, a signal line D, a pixel switching element PSW, a pixel electrode PE, a liquid crystal layer LQ, a common electrode CE, and the like, in each pixel PX. The display device DSP may comprise scanning line drivers GD and signal line drivers SD as explained later with reference to FIG. 4. For example, the scanning line drivers GD and the signal line drivers SD are arranged on the display panel PNL.

The display panel PNL is not limited to a liquid crystal display panel, but may be a mechanical display panel in which luminance of each pixel is controlled by, for example, a microelectromechanical system (MEMS) shutter, or a spontaneous light-emitting display panel using, for example, an organic light emitting diode (OLED). The display mode of the liquid crystal display panel is not particularly limited, either, but may be a display mode utilizing a lateral electric field or a display mode using a longitudinal electric field.

The control module CM supplies input signals SIN to the display control circuit 84. The input signals SIN include display data, clock signals, vertical synchronization signals, horizontal synchronization signals, display timing signals or the like, of the images. The display control circuit 84 executes alternation of the display data, timing adjustment and the like, and converts the display data into data in a data format suitable for supply to the display panel PNL. The display control circuit 84 supplies the converted display data to the scanning line driver GD and the signal line driver SD together with the synchronization signals. The DC supply module SM supplies an input voltage VIN to the power supply circuit 85. The power supply circuit 85 converts the input voltage VIN into various voltages and supplies the voltages to the scanning line driver GD, signal line driver SD, the display control circuit 84 and the like. The scanning line driver GD generates scanning signals, based on the supplied display data and voltages, and supplies the scanning signals to the respective pixels PX via the scanning lines G. Similarly, the signal line driver SD supplies the data signals to the respective pixels PX via the signal lines D.

Figure 2A:
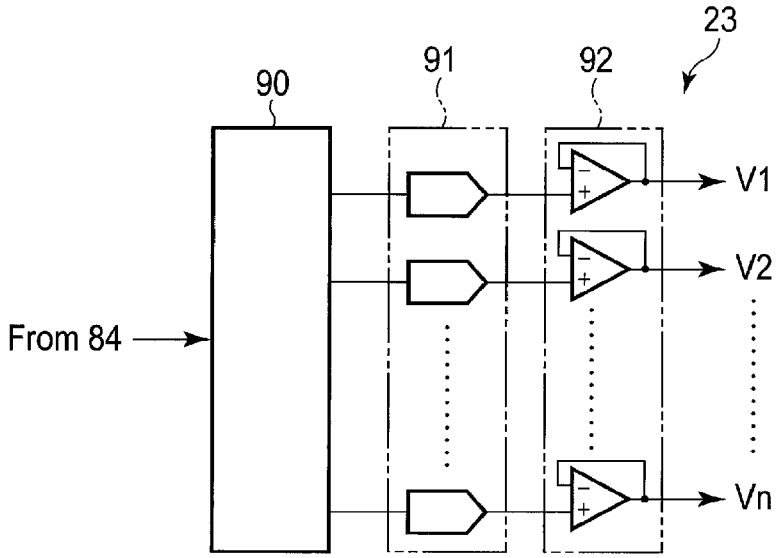
FIG. 2A is a diagram showing a configuration example of a gradation voltage generation circuit.
Figure 2B:
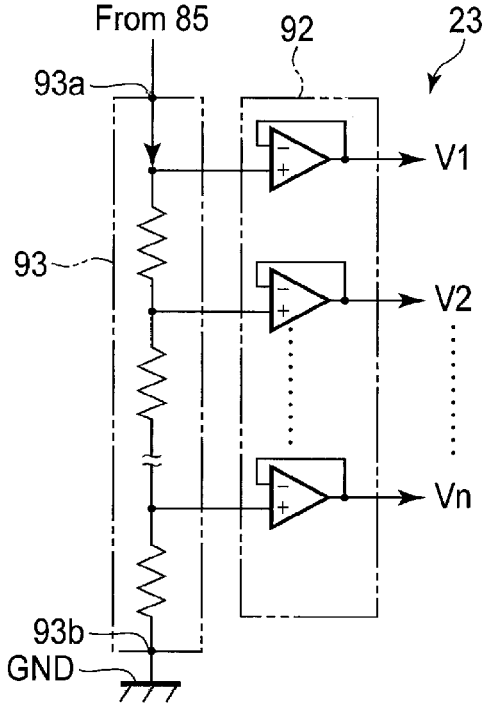
FIG. 2B is a diagram showing a configuration example of a gradation voltage generation circuit.

FIGS. 2A and 2B are diagrams showing a configuration example of a gradation voltage generation circuit. This figure shows a gradation voltage generation circuit 23 which generates n gradation voltages.

The gradation voltage generation circuit 23 is provided in, for example, the power supply circuit 85 and supplies gradation voltages for generation of the data signals to the signal line driver SD. The gradation voltage generation circuit 23 may be provided in the signal line driver SD. The gradation voltage generation circuit 23 shown in FIG. 2A is a digital circuit which totally controls the potential of each gradation voltage by a digital signal supplied from the display control circuit 84 via a serial bus, such as an inter-integrated circuit (I2C) or a serial peripheral interface (SPI). In contrast, the gradation voltage generation circuit 23 shown in FIG. 2B is an analog circuit which does not totally control the potential by using the display control circuit 84, but automatically determines the potential of the gradation voltage, based on a reference voltage VREF generated by the power supply circuit 85 and a resistance ratio of a ladder resistor 93.

The gradation voltage generation circuit 23 shown in FIG. 2A comprises a buffer circuit 90, a digital/analog (D/A) conversion circuit 91 and a buffer amplifier 92. The buffer amplifier 92 comprises the number corresponding to the gradation number of the output voltage, of operational amplifiers which function as voltage followers. The buffer circuit 90 temporarily stores the digital data input from the display control circuit 84. The digital data output from the buffer circuit 90 is input to the D/A conversion circuit 91 and converted into analog gradation voltages. The gradation voltages output from the D/A conversion circuit 91 are supplied to the buffer amplifier 92 and buffered by the operational amplifiers different from each other. The buffer amplifier 92 outputs the gradation voltages as n output voltages V1 to Vn different from each other. The D/A conversion circuit 91 is supplied with a reference voltage VREF from the power supply circuit 85 though not shown. For example, if the resolution of the D/A conversion circuit 91 is 10 bits (1024), the output voltage Vn can be represented by an equation $Vn=(Dn\times VREF)/1024$. Dn indicates digital setting data of the D/A conversion circuit 91 corresponding to the output voltage Vn.

The gradation voltage generation circuit 23 shown in FIG. 2B comprises a ladder resistor 93 and the buffer amplifier 92. An end 93*a* of the ladder resistor 93 is connected to the power supply circuit 85, and the other end 93*d* of the ladder resistor 93 is connected to the ground. The ladder resistor 93 comprises a plurality of resistors serially connected to each other, and nodes each existing between the end 93*a* and each of the resistors. Inputs of operational amplifiers provided in the buffer amplifier 92 are connected to nodes different from each other and are supplied with the gradation voltage from the ladder resistor 93. The gradation voltages buffered in the respective operational amplifiers are output as n output voltages V1 to Vn different from each other.

Figure 3:
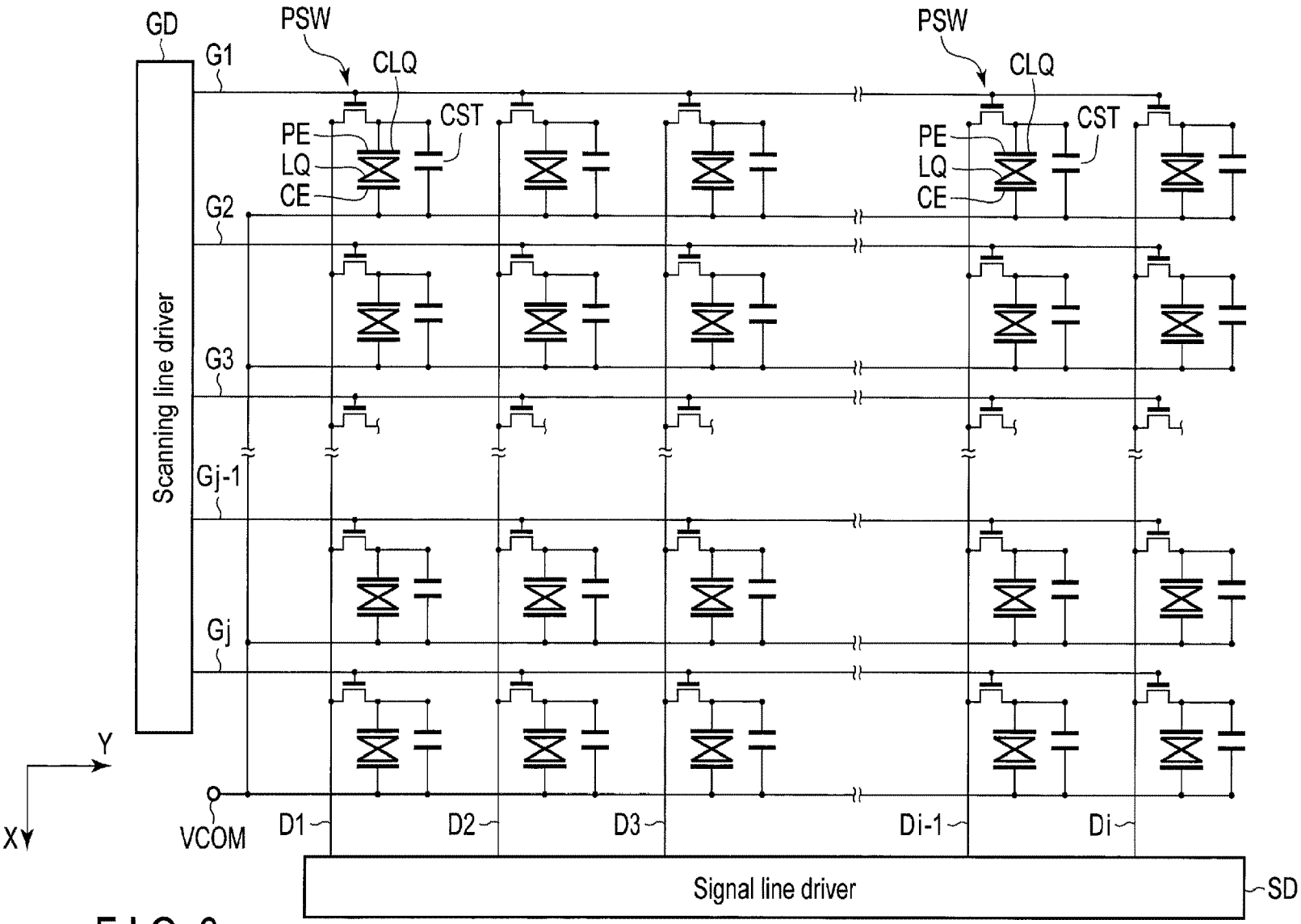
FIG. 3 is a diagram showing an equivalent circuit of the display device.

FIG. 3 is a diagram showing an equivalent circuit of the display device. In the example illustrated, the display device DSP is a liquid crystal display device. It should be noted that a first direction X shown in the figure is a direction which intersects a second direction Y.

The signal line driver SD is connected to i signal lines D (D1 to Di) extending in the first direction X to be arranged in the second direction Y. The scanning line driver GD is connected to j scanning lines G (G1 to Gj) extending in the second direction Y to be arranged in the first direction X. The signal lines D and the scanning lines G are connected to the pixel switching elements PSW at positions at which the lines intersect each other. The pixel electrode PE is connected to each pixel switching element PSW and a liquid crystal capacitance CLQ is formed between the pixel electrode PE and the common electrode CE. In addition, a storage capacitor CST is also formed between the pixel electrode PE and the common electrode CE. All the common electrodes CE are electrically connected to each other and are also connected to a common power supply VCOM.

The scanning line driver GD sequentially selects a scanning line from the first scanning line G1 to the j-th scanning line Gj, and supplies a scanning voltage to each of the scanning lines G during a horizontal scanning period. The scanning voltage which is a positive or negative bias voltage is supplied to a control electrode of the pixel switching element PSW connected to the first scanning line G1 to control electric connection (ON state or OFF state) between the signal line D and the pixel electrode PE via the pixel switching element PSW. The signal line driver SD supplies a data signal to the pixel switching element PSW connected to the first scanning line G1, via the signal line D, during the horizontal scanning period of the first scanning line G1. When the pixel switching element PSW is in the ON state, the data signal which is a gradation signal is written to the pixel electrode PE via the corresponding pixel switching element PSW and held by the liquid crystal capacitance CLQ and the storage capacitor CST. Similarly, the signal line driver SD writes the data signal to the pixel electrode PE corresponding to the scanning line, during each of horizontal scanning periods of the second scanning line G2 to the j-th scanning line Gj. A potential difference between the common electrode CE and the pixel electrode PE thus formed controls alignment of the liquid crystal molecules in the liquid crystal layer LQ.

Incidentally, if the display device DSP comprises signal line drivers SD, an error may occur on potential levels of the data signals generated by the respective signal line drivers SD due to a performance error of the power supply circuit 85 which supplies the gradation voltage to each of the signal line drivers SD. In such a case, a capacitance error corresponding to the potential error of the data signals may occur in each liquid crystal capacitance CLQ and the non-uniformity in display may occur at the display device DSP. Then, the present inventors invented a first embodiment and a second embodiment which will be explained below, as display devices DSP capable of suppressing the non-uniformity in display. The first embodiment will be explained with reference to FIG. 4 to FIG. 10. In addition, the second embodiment will be explained with reference to FIG. 11 to FIG. 15.

Figure 4:
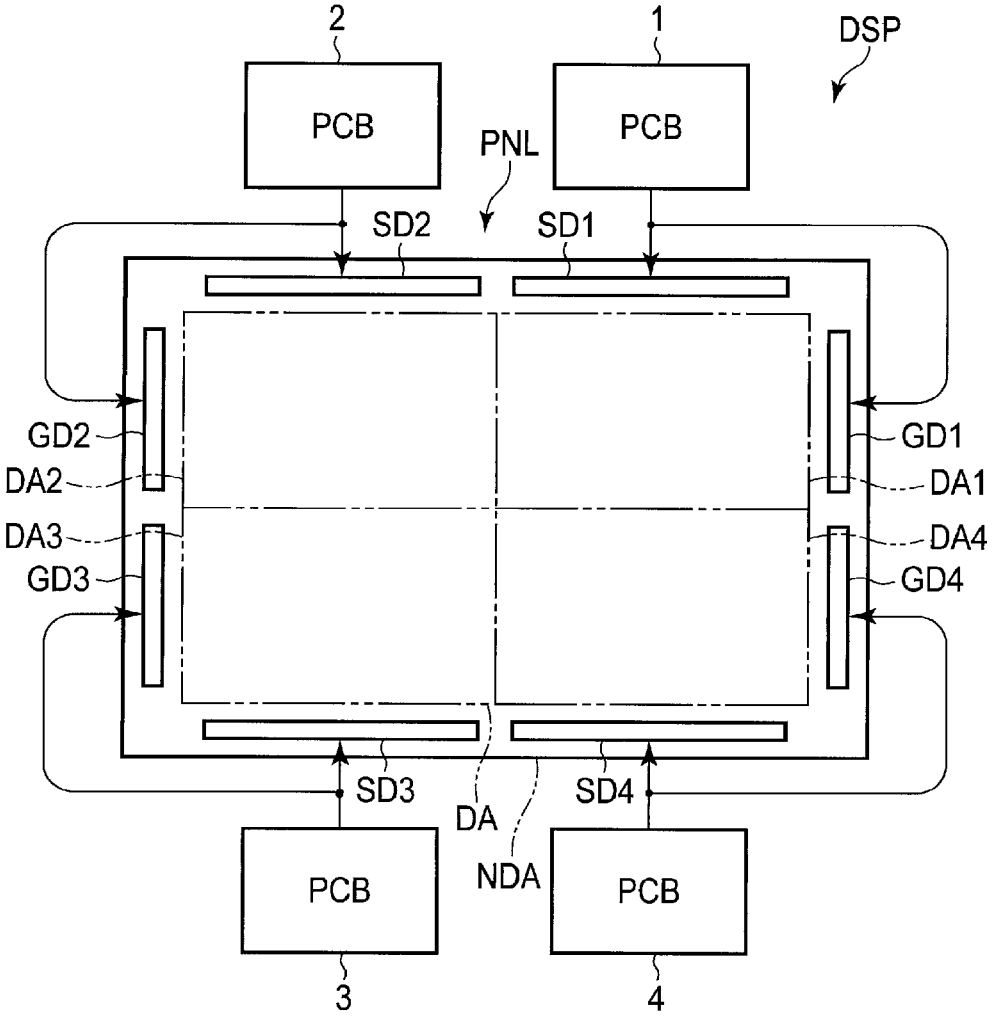
FIG. 4 is a block diagram showing an example of the display device in the divisional drive system including four divided display areas, according to a first embodiment.

FIG. 4 is a block diagram showing an example of the display device DSP in the divisional drive system including four divided display areas, according to the first embodiment.

The display panel PNL includes a first divided display area DA1, a second divided display area DA2, a third divided display area DA3 and a fourth divided display area DA4, in the display area DA. In the example illustrated, the display area DA is in a rectangular shape and each of the divided display areas is also in a rectangular shape. The first divided display area DA1 is located diagonally to the third divided display area DA3, and the second divided display area DA2 is located diagonally to the fourth divided display area DA4. Each of the first divided display area DA1 and the third divided display area DA3 is adjacent to the second divided display area DA2 and the fourth divided display area DA4. For example, the first divided display area DA1, the second divided display area DA2, the third divided display area DA3 and the fourth divided display area DA4 cooperate to display one image.

The display panel PNL includes in the non-display area NDA a first signal line driver SD1, a second signal line driver SD2, a third signal line driver SD3, a fourth signal line driver SD4, a first scanning line driver GD1, a second scanning line driver GD2, a third scanning line driver GD3, and a fourth scanning line driver GD4. The display device DSP comprises a first circuit board 1, a second circuit board 2, a third circuit board 3 and a fourth circuit board 4. The first signal line driver SD1 and the first scanning line driver GD1 are located near the first divided display area DA1 and connected to the first circuit board 1. Similarly, the second signal line driver SD2 to the fourth signal line driver SD4, and the second scanning line driver GD2 to the fourth scanning line driver GD4 are located near the second divided display area DA2 to the fourth divided display area DA4, and connected to the second circuit board 2 to the fourth circuit board 4, respectively.

The first divided display area DA1 is supplied with a data signal from the first signal line driver SD1 and a scanning signal from the first scanning line driver GD1. Similarly, data signals and scanning signals corresponding to the respective divided display areas are supplied from the second signal line driver SD2 and the second scanning line driver GD2 to the second divided display area DA2, from the third signal line driver SD3 and the third scanning line driver GD3 to the third divided display area DA3, and from the fourth signal line driver SD4 and the fourth scanning line driver GD4 to the fourth divided display area DA4.

The first signal line driver SD1 and the first scanning line driver GD1 are supplied with display data, a gradation voltage and the like from the first circuit board 1. Similarly, display data signals and gradation voltages corresponding to the respective drivers are supplied from the second circuit board 2 to the second signal line driver SD2 and the second scanning line driver GD2, from the third circuit board 3 to the third signal line driver SD3 and the third scanning line driver GD3, and from the fourth circuit board 4 to the fourth signal line driver SD4 and the fourth scanning line driver GD4.

As explained above, the display device DSP comprises the display panel PNL which displays the image on the display area DA including a plurality of divided display areas, a plurality of signal line drivers which supply the corresponding data signals to the respective divided display areas, and a plurality of circuit boards which supply the gradation voltages to generate the data signals to the respective signal line drivers.

Figure 5:
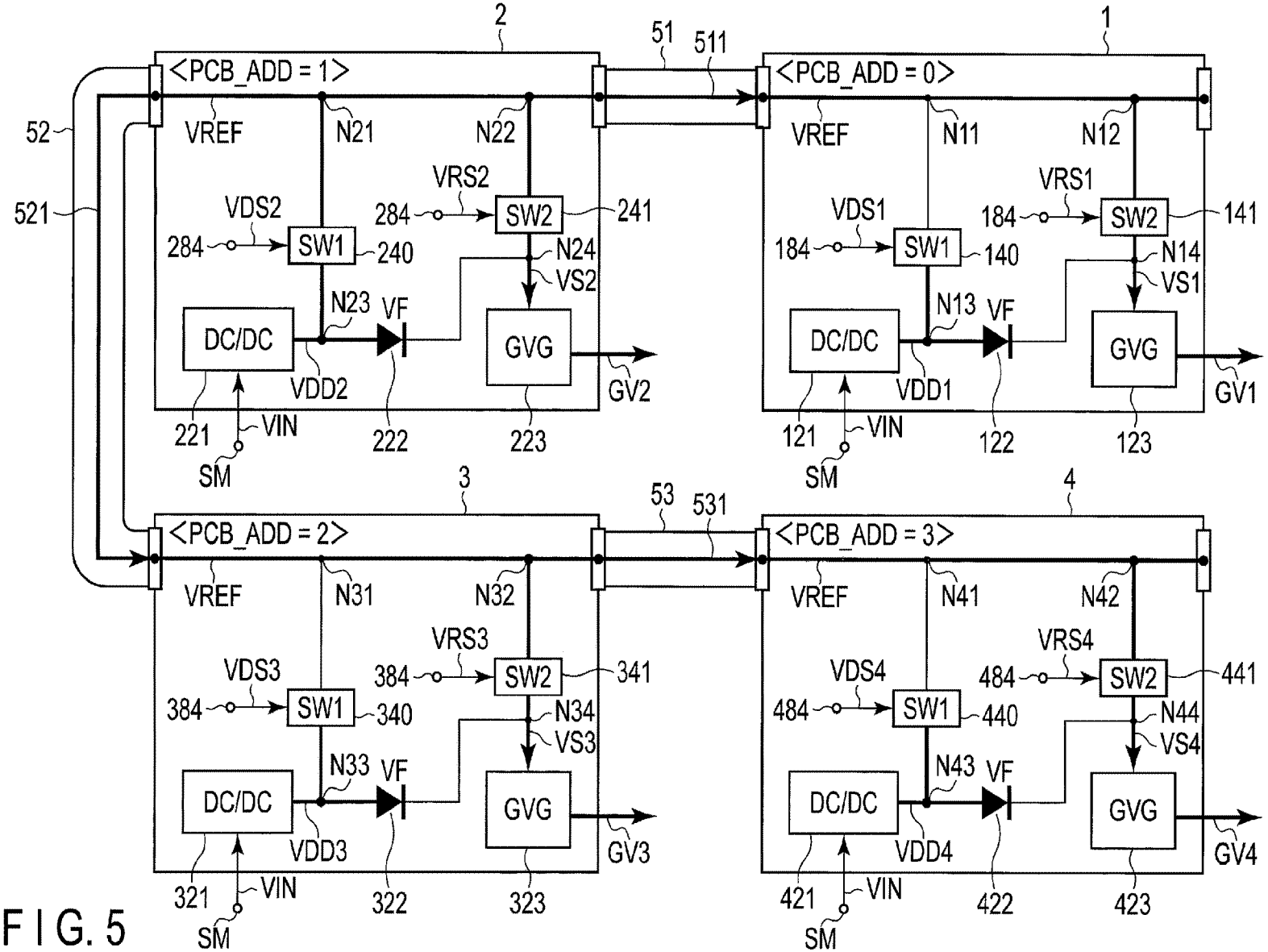
FIG. 5 is a diagram showing a circuit board and its circuit configuration example, of the display device according to the first embodiment.

FIG. 5 is a diagram showing a circuit board and its circuit configuration example, of the display device according to the first embodiment. A situation in which the gradation voltages are generated in the first circuit board 1 to the fourth circuit board 4 is illustrated in FIG. 5. In the explanation below, each display control circuits 184, 284, 384, 484 corresponds to the display control circuit 84 in FIG. 1, and each power supply circuits 121, 221, 321, 421 corresponds to the power supply circuit 85 in FIG. 1. The display control circuits 184 to 484 may be independent circuits each other or form in a same circuit. The power supply circuits 121 to 421 may be independent circuits each other or form in a same circuit.

The display device DSP comprises a first connection member 51, a second connection member 52 and a third connection member 53. The first connection member 51 connects the first circuit board 1 and the second circuit board 2. The second connection member 52 connects the second circuit board 2 and the third circuit board 3. The third connection member 53 connects the third circuit board 3 and the fourth circuit board 4. Each of the connection members is, for example, a flexible flat cable (FFC) or a flexible printed circuit (FPC), but connection components are not limited. The first connection member 51 includes a first connection line 511, the second connection member 52 includes a second connection line 521 and the third connection member 53 includes a third connection line 531. The connection lines and the circuit boards are interconnected alternately. The second circuit board 2 is handled as a master board 2 in this example.

The first circuit board 1 includes a power supply circuit (DC/DC) 121, a gradation voltage generation circuit (GVG) 123, an output switching circuit (SW1) 140, an input switching circuit (SW2) 141, a diode 122, a first node N11, a second node N12, a third node N13, and a fourth node N14. The first circuit board 1 also includes display control circuit 184 (not shown).

The first node N11 exists on the circuit connected to the first connection line 511. The output switching circuit 140 is arranged on the circuit which connects the power supply circuit 121 and the first node N11, to control supply of the voltage from the power supply circuit 121 to the first node N11. The second node N12 exists on the circuit which connects the output switching circuit 140 and the first connection line 511, and connected to the gradation voltage generation circuit 123 via the input switching circuit 141. The input switching circuit 141 controls supply of the voltage from the second node N12 to the gradation voltage generation circuit 123. The third node N13 exists on the circuit which connects the power supply circuit 121 and the output switching circuit 140. The fourth node N14 exists on the circuit which connects the input switching circuit 141 and the gradation voltage generation circuit 123. The diode 122 is arranged on the circuit which connects the third node N13 and the fourth node N14, and connected parallel to the output switching circuit 140 and the input switching circuit 141. The diode 122 is also connected in a forward direction from the power supply circuit 121 to the gradation voltage generation circuit 123. The display control circuit 184 controls an OFF state and an ON state of the output switching circuit 140 by supplying a control signal VDS1 and controls an OFF state and an ON state of the input switching circuit 141 by supplying a control signal VRS1. Each of the switching circuits interrupts a current in the OFF state and allows a current to pass in the ON state.

Similarly to the first circuit board 1, the second circuit board 2 includes a power supply circuit 221, a gradation voltage generation circuit 223, an output switching circuit 240, an input switching circuit 241, a diode 222, a first node N21, a second node N22, a third node N23, and a fourth node N24. On the second circuit board 2, the first node N21 exists on the circuit connected to the first connection line 511 and the second connection line 521. The second node N22 exists on the circuit connected to the output switching circuit 240, the first connection line 511 and the second connection line 521, and is connected to the gradation voltage generation circuit 223 via the input switching circuit 241. In addition, display control circuit 284 (not shown) supplies a control signal VDS2 and a control signal VRS2 to the output switching circuit 240 and the input switching circuit 241, respectively.

Similarly, the third circuit board 3 includes a power supply circuit 321, a gradation voltage generation circuit 323, an output switching circuit 340, an input switching circuit 341, a diode 322, a first node N31, a second node N32, a third node N33, and a fourth node N34. On the third circuit board 3, the first node N31 exists on the circuit connected to the second connection line 521 and the third connection line 531. The second node N32 exists on the circuit connected to the output switching circuit 340, the second connection line 521 and the third connection line 531, and is connected to the gradation voltage generation circuit 323 via the input switching circuit 341. In addition, display control circuit 384 (not shown) supplies a control signal VDS3 and a control signal VRS3 to the output switching circuit 340 and the input switching circuit 341, respectively.

Similarly, the fourth circuit board 4 includes a power supply circuit 421, a gradation voltage generation circuit 423, an output switching circuit 440, an input switching circuit 441, a diode 422, a first node N41, a second node N42, a third node N43, and a fourth node N44. On the fourth circuit board 4, the first node N41 exists on the circuit connected to the third connection line 531. The second node N42 exists on the circuit connected to the output switching circuit 440 and the third connection line 531, and is connected to the gradation voltage generation circuit 423 via the input switching circuit 441. In addition, display control circuit 484 (not shown) supplies a control signal VDS4 and a control signal VRS4 to the output switching circuit 440 and the input switching circuit 441, respectively.

The circuit boards 1 to 4 are different from each other with respect to the connected connection lines and supply destinations of the generated gradation voltages, but have the same circuit configuration. It should be noted that the control signal VDS2 of the master board 2 is transmitted to all the circuit boards 1 to 4, similarly to a reference voltage VREF to be explained later. In each of the circuit boards 1 to 4, the control signals VRS1 to VRS4 are supplied at the same timing delayed from the control signal VDS2 by a certain time, based on the control signal VDS2.

Board addresses (PCB_ADD=0, 1, 2, and 3) are preliminarily allocated to the first to fourth circuit boards 1 to 4 in accordance with arrangement, and a master board and slave boards are determined by the display control circuits 184, 284, 384 and 484 of the respective circuit boards. The display control circuits 184 to 484 can control operation states of the respectively corresponding first to fourth circuit boards 1 to 4. The master board is a circuit board which supplies the reference voltage VREF from the own power supply circuit to all the circuit boards. The slave board is a circuit board which generates the gradation voltage in accordance with the reference voltage VREF supplied from the power supply circuit provided on the master board. In the example illustrated, the first circuit board 1 is designated by PCB_ADD=0, the second circuit board 2 is designated by PCB_ADD=1, the third circuit board 3 is designated by PCB_ADD=2, and the fourth circuit board 4 is designated by PCB_ADD=3. In addition, in the example illustrated, the second circuit board 2 designated by PCB_ADD=1 is the master board while the first circuit board 1, the third circuit board 3 and the fourth circuit board 4 designated by PCB_ADD=0, 2, and 3 are the slave boards. The circuit board, which has a shorter power supply path to both ends of circuit boards than other circuit boards, is desirably designated as the master board since the line resistance loaded on the reference voltage VREF by each connection line is reduced. In other words, it is desirable that the circuit board at the end should not be designated as the master board and that two connection lines should be connected to the master board. In the example illustrated, the second circuit board 2 or the third circuit board 3 is desirably designated as the master board. A system of supplying the reference voltage of all the circuit boards from the power supply circuit of the master board may be called a reference voltage supply system.

When the gradation voltages are generated in all the circuit boards, the input voltage VIN is input from the DC supply module SM to the power supply circuits 121, 221, 321 and 421. On the master board 2, the output switching circuit 240 and the input switching circuit 241 are in the ON state. On the slave board 1, the output switching circuit 140 is in the OFF state and the input switching circuit 141 are in the ON state. On the slave boards 3 and 4, too, the circuits are in the same states as those on the slave board 1.

A power source voltage VDD2 output from the power supply circuit 221 provided on the master board 2 is supplied to the first node N21 through the output switching circuit 240, as the reference voltage VREF. The reference voltage VREF is supplied to the gradation voltage generation circuit 223 through the second node N22 and the input switching circuit 141, as the supply voltage VS2. The gradation voltage generation circuit 223 generates a gradation voltage GV2 in accordance with the supply voltage VS2. It should be noted that a voltage is not supplied from the third node N23 to the fourth node N24 through the diode 222 since the potential of the fourth node N24 is equal to the potential of the third node N23.

On the slave board 1, the reference voltage VREF generated on the master board 2 is supplied to the first node N11 through the first connection line 511. The reference voltage VREF is supplied to the gradation voltage generation circuit 123 through the second node N12 and the input switching circuit 141 in the ON state, as the supply voltage VS1. The gradation voltage generation circuit 123 generates a gradation voltage GV1 in accordance with the supply voltage VS1. The power source voltage VDD1 supplied from the power supply circuit 121 to the output switching circuit 140 is interrupted by the output switching circuit 140 in the OFF state. In this example, a voltage is not supplied from the third node N13 to the fourth node N24 through the diode 122 since a potential difference VDD1−VS1 between the fourth node N14 and the third node N13 is smaller than a threshold voltage (voltage drop) VF of the diode 122.

On the slave board 3, too, the reference voltage VREF is supplied from the master board 2 to the first node N31 through the second connection line 521, similarly to the slave board 1. Then, the gradation voltage generation circuit 323 supplied with the supply voltage VS3 generates a gradation voltage GV3, similarly to the slave board 1. On the slave board 4, too, the reference voltage VREF is supplied from the master board 2 to the first node N41 through the second connection line 521, the internal circuit of the slave board 3, and the third connection line 531, similarly to the slave board 1. Then, the gradation voltage generation circuit 423 supplied with the supply voltage VS4 generates a gradation voltage GV4, similarly to the slave board 1.

Next, a sequence of power-on in each circuit board will be explained with reference to a timing chart.

Figure 6:
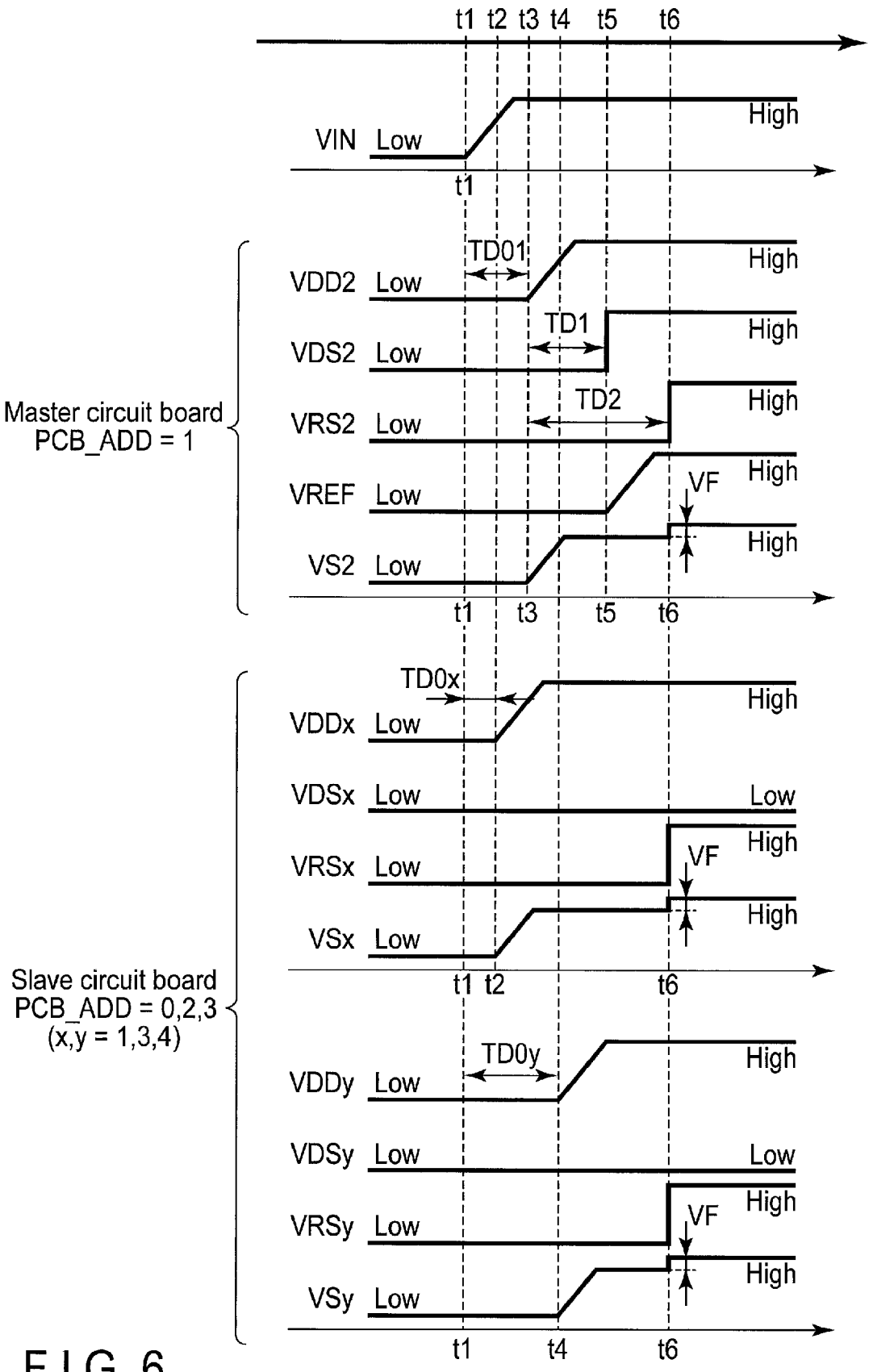
FIG. 6 is a timing chart showing an operation example of the display device according to the first embodiment.

FIG. 6 is a timing chart showing an operation example of the display device according to the first embodiment.

First, the input voltage VIN is input from the DC supply module SM at time t1. At this time, each control signal is low, and all the output switching circuits and the input switching circuits are in the OFF state.

Next, the power supply circuit 221 starts rise of the power source voltage VDD2 at, for example, time t3, on the master board 2 supplied with the input voltage VIN. On the respective slave boards, too, the power supply circuit 121 starts rise of the power source voltage VDD1, the power supply circuit 321 starts rise of the power source voltage VDD3, and the power supply circuit 421 starts rise of the power source voltage VDD4. At this time, an error may often occur at start timing of the rise of the power source voltages. In the example illustrated, the power source voltage VDD2 starts the rise when TD01 has passed after input time t1 of the input voltage VIN (time t3). Some of the power source voltages VDD1, VDD3 and VDD4 of the respective slave boards start the rise before TD01 has elapsed after input time t1 (time t2), and some of the power source voltages start the rise when TD01 has elapsed after input time t1 (time t4).

In FIG. 6, the voltage and control signals of the modules on the master board 2 are represented as voltage VDD2 and control signals VDS2 and VRS2. As regards the slave boards 1, 3, and 4, however, the voltages of the modules are generalized as VDDx, VDDy, VSx, and VSy and the control signals of the modules are generalized as VDSx, VDSy, VRSx, and VRSy.

At this time, on the master board 2, a supply voltage VS2 supplied to the gradation voltage generation circuit 223 is an auxiliary voltage which is supplied from the power supply circuit 221 to the fourth node N24 through the diode 222. The potential of the auxiliary voltage is assumed to be VDD2−VF obtained by subtracting a voltage drop VF of the diode 222 from the power source voltage VDD2 of the power supply circuit 221. Similarly, an auxiliary voltage (VDD1−VF) is supplied as a supply voltage VS1 on the slave board 1, an auxiliary voltage (VDD3−VF) is supplied as a supply voltage VS3 on the slave board 3, and an auxiliary voltage (VDD4−VF) is supplied as a supply voltage VS4 on the slave board 4.

At time t5 at which TD1 has elapsed after the rise time t3 of the power source voltage VDD2, the power source voltages become high and the outputs of the respective power supply circuits become stable, on all the circuit boards. At this time, the control signal VDS2 of the master board 2 is switched from low to high, and the output switching circuit 240 is turned on. The control signal VDS1 of the slave board 1 remains low, and the output switching circuit 140 remains in the OFF state. On the slave boards 3 and 4, too, the output switching circuits 340 and 440 remain in the OFF state.

At time t6 at which TD2 has elapsed after the rise start time t3 of the power source voltage VDD2, the auxiliary voltages become stable in all the gradation voltage generation circuits. It should be noted that TD2 is longer than TD1. At time t6, the control signals VRS1, VRS2, VRS3, and VRS4 are simultaneously switched from low to high, and the input switching circuits 141, 241, 341 and 441 are simultaneously turned on, on all the circuit boards. The reference voltage VREF generated in the power supply circuit 221 of the master board 2 is thereby supplied simultaneously to the gradation voltage generation circuits of all the circuit boards, through the input switching circuits of the respective circuit boards. In other words, the potentials of the supply voltages VS1, VS2, VS3, and VS4 rise by VF from the auxiliary voltages, respectively, at time t6.

Figure 7:
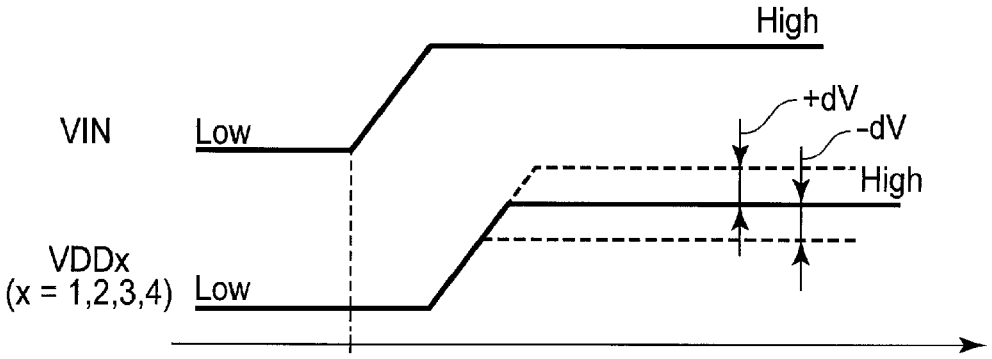
FIG. 7 is a timing chart showing an example of a voltage error between power supply circuits provided on respective circuit boards.

FIG. 7 is a timing chart showing an example of a voltage error between the power supply circuits provided on the respective circuit boards.

In the power supply circuits, an error may occur at the timing of starting the output of the power source voltages, and an error may also occur in the potentials of the output power source voltages, due to irregularity in performance. For example, an error voltage of the power source voltages VDD1, VDD2, VDD3, and VDD4 is ±dV. The maximum potential difference between the power source voltage VDD2 of the master board and any one of the power source voltage VDD1, VDD3 and VDD4 of the slave boards is therefore 2 dV. To cause the gradation voltages corresponding to the reference voltage VREF to be generated on all the circuit boards, supply of the voltages to the gradation voltage generation circuits through the diodes at the gradation voltage generation time needs to be stopped. In other words, a potential difference between the fourth node and the third node needs to be smaller than a threshold voltage VF of the diode, on each of the slave boards. The maximum potential difference between the fourth node and the third node on the slave boards, which occurs due to the error of power source voltage between the master board and the slave boards is 2 dV, in a state in which the output switching circuit (SW1) of the master board is turned on, the output switching circuit (SW1) of each slave board is turned off, and all the input switching circuits (SW2) are turned on. Thus, in the present embodiment, VF is desirably greater than 2 dV in all the diodes and the power supply circuits.

In the present embodiment, the display device DSP comprises the input switching circuits 141, 241, 341 and 441, but may not comprise these input switching circuits. In other words, the reference voltage VREF output from the master board 2 may be supplied directly to the gradation voltage generation circuits 123, 223, 323 and 423. In this display device DSP, for example, the timing of supplying the reference voltage VREF can be controlled by the output switching circuit provided on each of the circuit boards. In other words, in the display device DSP, the reference voltage VREF may be supplied simultaneously to all the supply voltages VS1, VS2, VS3, and VS4 at the timing at which the output switching circuit 240 provided on the master board 2 alone is turned on. At this time, the output switching circuits 140, 340 and 440 provided on the respective slave boards 1, 3, and 4 remain in the OFF state.

In the first embodiment, as explained above, the reference voltage VREF output from the power supply circuit 221 provided on the master board 1 is supplied to all the gradation voltage generation circuits 123, 223, 323, and 423 as the supply voltages VS1, VS21, VS3, and VS4, and the gradation voltages GV1, GV2, GV3, and GV4 are generated. Thus, according to the present embodiment, the shift of gradation voltage resulting from the potential error of the power source voltages output from the respective power supply circuits can be suppressed, and a difference in luminance or non-uniformity in display in the divisional display areas can also be suppressed. In addition, in the display device DSP, the timing of supplying the reference voltage VREF to the gradation voltage generation circuits 123, 223, 323, and 423 can be controlled by the input switching circuits 141, 241, 341, and 441. Thus, according to the present embodiment, the timing of outputting the gradation voltages GV1, GV2, GV3, and GV4 can be made to correspond to each other, and a disturbance of display images on the divisional display areas can be suppressed. In other words, according to the present embodiment, the high-definition display device DSP capable of improving the display quality can be provided.

Incidentally, the gradation voltage and the voltage for drive need to be simultaneously input to the signal line driver SD as drive conditions, for specifications. In the first embodiment, the power source voltages VDD1 to VDD4 are supplied to the gradation voltage generation circuits 123, 223, 323, and 423 via the diodes 122, 222, 322, and 422, as the auxiliary voltages (VDD1–VF, VDD2–VF, VDD3–VF, and VDD4–VF), respectively, before the supply of the reference voltage VREF is started. The auxiliary voltages are thus used at the asynchronous timing immediately after the power-on. The signal line driver SD already meets the drive conditions at the asynchronous timing, by the auxiliary voltages. Next, VDDx are stable as the power sources for drive as explained with reference to FIG. 6 and FIG. 7, at the synchronous timing at which the circuit boards 1 to 4 synchronously output the gradation voltages GV1 to GV4, respectively. Thus, a period of transition in which an overcurrent flows before the output of the gradation voltage generation circuit becomes stable overlaps the above-explained asynchronous timing. At the synchronous timing, occurrence of the latch-up can be suppressed since the output of the gradation voltage generation circuit becomes stable.

Next, modified examples of the first embodiment will be explained sequentially with reference to FIG. 8 to FIG. 10. In the modified examples, the same advantages as those of the first embodiment can be obtained from the display device DSP.

Figure 8:
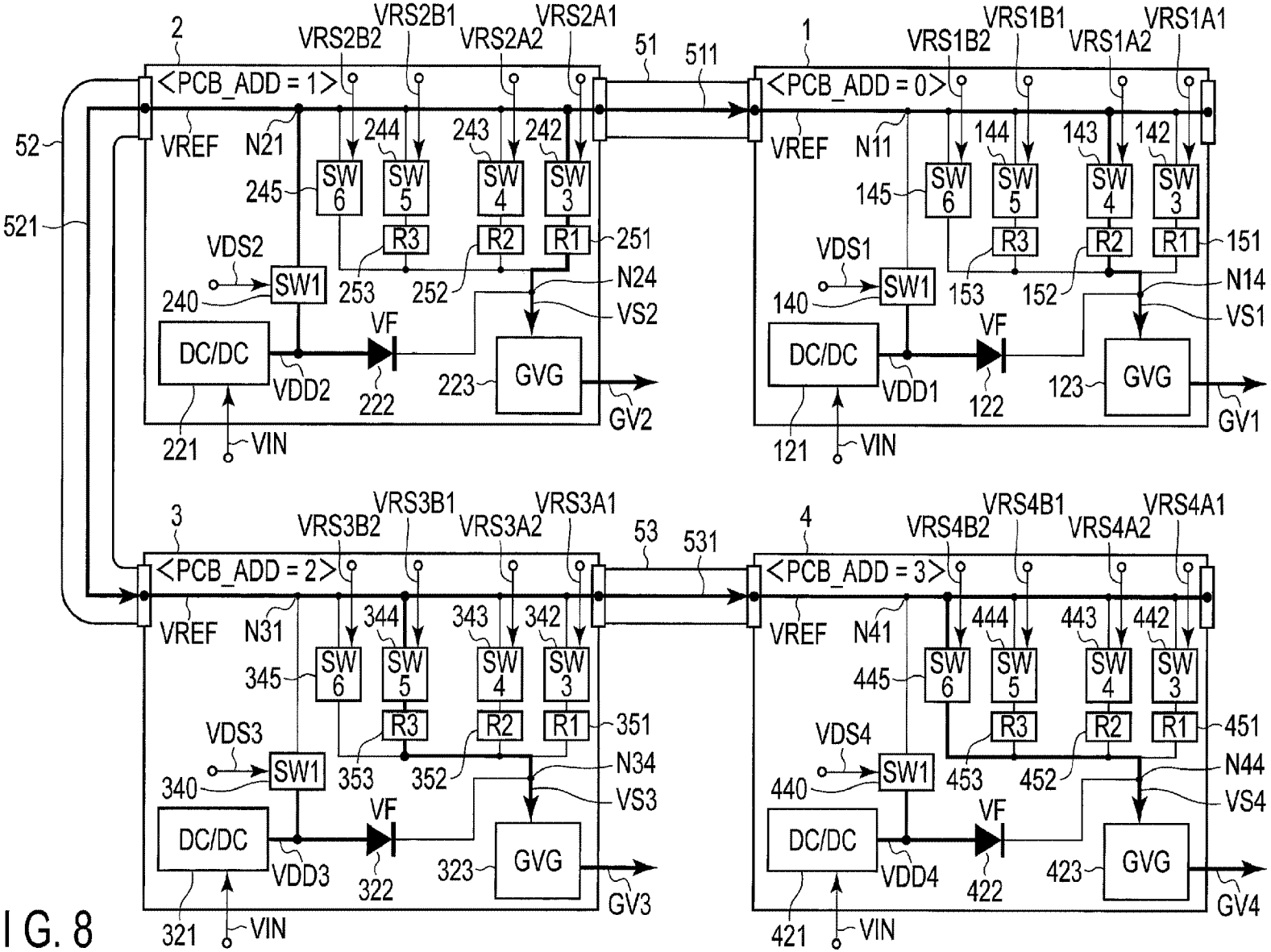
FIG. 8 is a diagram showing a circuit board and its circuit configuration example, of the display device according to a first modified example.

FIG. 8 is a diagram showing a circuit board and its circuit configuration example, of the display device according to a first modified example. The present modified example is different from the first embodiment with respect to a feature of providing a plurality of input switching circuits connected parallel to each other, between the first node and the gradation voltage generation circuit, on each of the circuit boards. The present modified example is also different from the first embodiment with respect to a feature of providing an input-side resistor connected serially to the input switching circuit and having a resistance value equal to that of the line resistance of the connection line, on each of the circuit boards.

On the first circuit board 1, a circuit making a connection between the first node N11 and the fourth node N14 is branched to four paths. A first input switching circuit (SW3) 142 and a first input-side resistor 151 are provided on a circuit of a first path. A second input switching circuit (SW4) 143 and a second input-side resistor 152 are provided on a circuit of a second path. A third input switching circuit (SW5) 144 and a third input-side resistor 153 are provided on a circuit of a third path. A fourth input switching circuit (SW6) 145 is provided on a circuit of a fourth path. The first input switching circuit 142 is controlled by a control signal VRS1A1, the second input switching circuit 143 is controlled by a control signal VRS1A2, the third input switching circuit 144 is controlled by a control signal VRS1B1, and the fourth input switching circuit 145 is controlled by a control signal VRS1B2.

A resistance value of the first connection line 511 is R51. A resistance value of the second connection line 521 is R52. A resistance value of the third connection line 531 is R53, which is assumed to be equal to R51. A resistance value R1 of the first input-side resistor 151 is assumed to be equal to a sum of R51 and 2×R52. A resistance value R2 of the second input-side resistor 152 is equal to 2×R52. A resistance value R3 of the third input-side resistor 153 is assumed to be equal to R51.

The second circuit board 2 has the same circuit configuration as the first circuit board 1. The second circuit board 2 includes a first input switching circuit 242, a first input-side resistor 251 of a resistance value R1, a second input switching circuit 243, a second input-side resistor 252 of a resistance value R2, a third input switching circuit 244, a third input-side resistor 253 of a resistance value R3, and a fourth input switching circuit 245. Similarly, the third circuit board 3 includes a first input switching circuit 342, a first input-side resistor 351 of a resistance value R1, a second input switching circuit 343, a second input-side resistor 352 of a resistance value R2, a third input switching circuit 344, a third input-side resistor 353 of a resistance value R3, and a fourth input switching circuit 345. Similarly, the fourth circuit board 4 includes a first input switching circuit 442, a first input-side resistor 451 of a resistance value R1, a second input switching circuit 443, a second input-side resistor 452 of a resistance value R2, a third input switching circuit 444, a fourth input-side resistor 453 of a resistance value R3, and a fourth input switching circuit 445.

Similarly to the first embodiment, the second circuit board 2 is assumed to function as the master board, and the first circuit board 1, the third circuit board 3 and the fourth circuit board 4 are assumed to function as the slave boards, in the present modified example.

When the gradation voltage is generated, the second input switching circuit 143 is in the ON state while the first output switching circuit 140, the first input switching circuit 142, the third input switching circuit 144, and the fourth input switching circuit 145 are in the OFF state, on the slave board 1. At this time, the reference voltage VREF supplied from the master board 2 in the first connection line 511 through the second input switching circuit 143 and the second input-side resistor 152 of the second path becomes the supply voltage VS1. In the master board 2, the first output switching circuit 240 and the first input switching circuit 242 are in the ON state while the second input switching circuit 243, the third input switching circuit 244, and the fourth input switching circuit 245 are in the OFF state. At this time, the reference voltage VREF supplied through the first input switching circuit 242 and the first input-side resistor 251 of the first path becomes the supply voltage VS2. In the slave board 3, the third input switching circuit 344 is in the ON state while the first output switching circuit 340, the first input switching circuit 342, the second input switching circuit 343, and the fourth input switching circuit 345 are in the OFF state. At this time, the reference voltage VREF supplied from the master board 2 in the second connection line 521 through the third input switching circuit 344 and the third input-side resistor 353 of the third path becomes the supply voltage VS3. In the slave board 4, the fourth input switching circuit 445 is in the ON state while the first output switching circuit 440, the first input switching circuit 442, the second input switching circuit 443, and the third input switching circuit 444 are in the OFF state. At this time, the reference voltage VREF supplied from the master board 2 in the second connection line 521 and the third connection line 531 through the fourth input switching circuit 445 of the fourth path becomes the supply voltage VS4. Since the reference voltage VREF in the master board 2 is equivalent to the power source voltage VDD2, the supply voltages VS1, VS2, VS3 and VS4 become equivalent as explained below, by the voltage drop in the connection lines and the input-side resistors. The consumption current in each of the gradation voltage generation circuits is represented by I. The current flowing to the resistors and the connection lines is assumed to be I in the first input-side resistor 251, I in the first connection line 511, I in the second input-side resistor 152, 21 in the second connection line 521, I in the third input-side resistor 353, and I in the third connection line 531.

$$VS1=VDD2-I\times R51-I\times R2=VDD2-I\times R51-2\times I\times R52$$

$$VS2=VDD2-I\times R1=VDD2-I\times R51-2\times I\times R52$$

$$VS3=VDD2-2I\times R52-I\times R3=VDD2-I\times R51-2\times I\times R52$$

$$VS4=VDD2-2I\times R52-I\times R53=VDD2-I\times R51-2\times I\times R52$$

Thus, the resistance values of the resistors are selected such that the voltages supplied to the gradation voltage generation circuits become approximately equivalent to each other in response to impedances of the respective connection lines.

According to the above-explained modified examples, since the display device DSP can suppress the voltage errors of the supply voltages VS1, VS2, VS3 and VS4 caused by voltage drop of the reference voltage VREF in the first connection line 511, the second connection line 521, and the third connection line 531, the display device DSP can suppress the shift of the gradation voltages GV1, GV2, GV3 and GV4. According to the display device DSP of the present modified example, the display quality therefore can be further improved.

Figure 9:
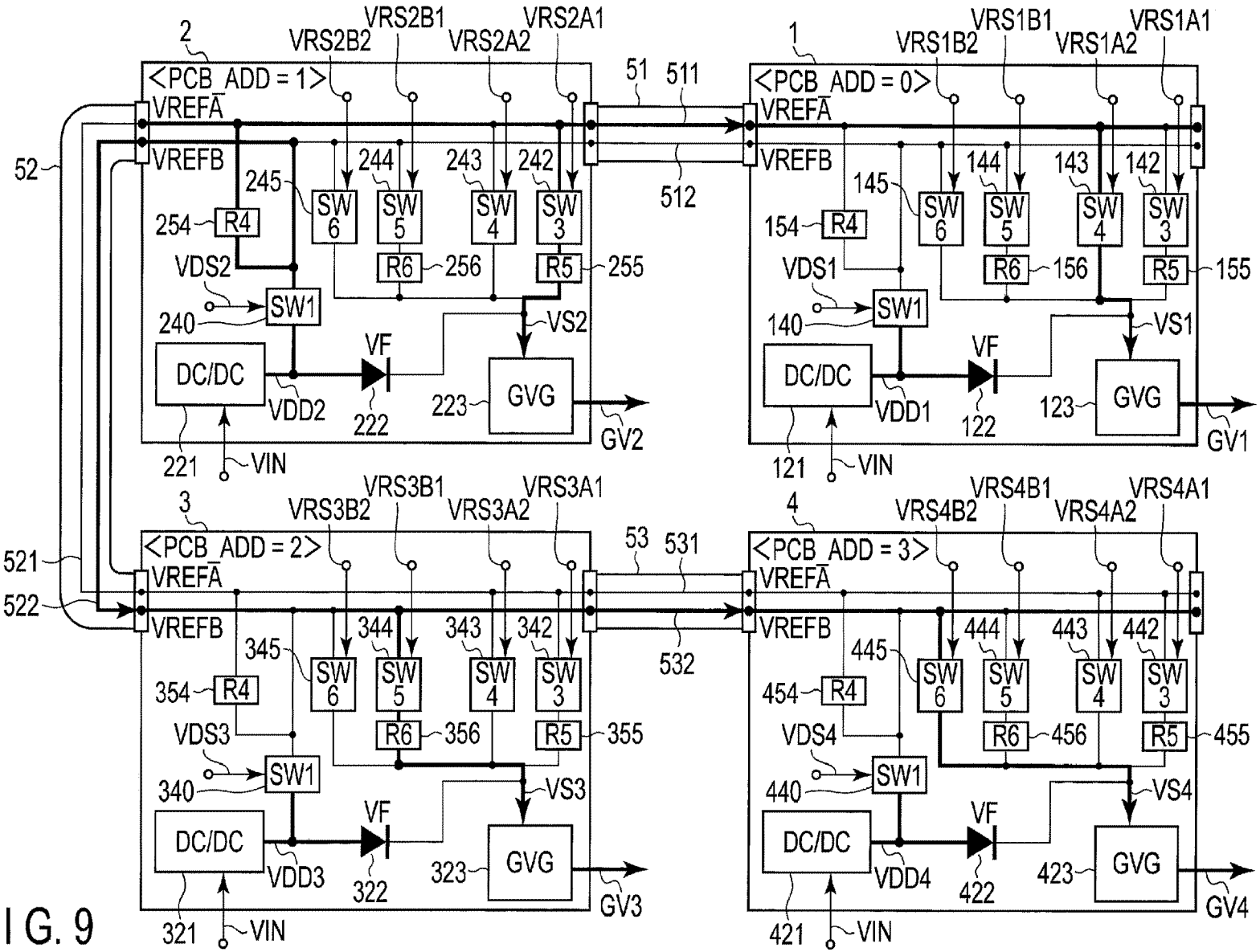
FIG. 9 is a diagram showing a circuit board and its circuit configuration example, of the display device according to a second modified example.

FIG. 9 shows a circuit board and its circuit configuration example, of the display device of the second modified example. The present modified example is different from the first modified example with respect to a feature of further including a fourth connection line 512 in the first connection member 51, further including a fifth connection line 522 in the second connection member 52, and further including a sixth connection line 532 in the third connection member 53. The first connection line 511, the second connection line 521 and the third connection line 531 correspond to a first system connection line, and the fourth connection line 512, the fifth connection line 522 and the sixth connection line 532 correspond to a second system connection line. The first system connection line and the output switching circuit are connected to each other via the output-side resistor. In other words, the potential of the first reference voltage VREFA supplied to the first system connection line is different from the potential of the second reference voltage VREFB supplied to the second system connection line due to the voltage drop at the output-side resistor.

The first circuit board 1 includes an output-side resistor 154 on a circuit which connects the output switching circuit 140 and the first system connection line to each other. The first path and the second path are connected to the first connection line 511. The third path and the fourth path are connected to the fourth connection line 512. A fourth input-side resistor 155 is provided serially with the first input switching circuit 142, on the circuit of the first path. A fifth input-side resistor 156 is provided serially with the third input switching circuit 144, on the circuit of the third path.

A resistance value of the first connection line 511 and the fourth connection line 512 is R51. A resistance value of the second connection line 521 and the fifth connection line 522 is R52. A resistance value of the third connection line 531 and the sixth connection line 532 is R53, which is assumed to be equal to R51. A resistance value R4 of the output-side resistor 154 is assumed to be equal to R52. A resistance value R5 of the fourth input-side resistor 155 is assumed to be equal to R51. A resistance value R6 of the fifth input-side resistor 156 is assumed to be equal to R51.

The second circuit board 2 has the same circuit configuration as the first circuit board 1. The second circuit board 2 includes an output-side resistor 254 of the resistance value R4, a fourth input-side resistor 255 of the resistance value R5, which is connected serially to the first input switching circuit 242, and a fifth input-side resistor 256 of the resistance value R6, which is connected serially to the third input switching circuit 244. Similarly, the third circuit board 3 includes an output-side resistor 354 of the resistance value R4, a fourth input-side resistor 355 of the resistance value R5, which is connected serially to the first input switching circuit 342, and a fifth input-side resistor 356 of the resistance value R6, which is connected serially to the third input switching circuit 344. Similarly, the fourth circuit board 4 includes an output-side resistor 454 of the resistance value R4, a fourth input-side resistor 455 of the resistance value R5, which is connected serially to the first input switching circuit 442, and a fifth input-side resistor 456 of the resistance value R6, which is connected serially to the third input switching circuit 444.

In the present modified example, too, the second circuit board 2 is assumed to function as the master board, and the first circuit board 1, the third circuit board 3 and the fourth circuit board 4 are assumed to function as the slave boards.

When the gradation voltage is generated, the second input switching circuit 143 is in the ON state while the first output switching circuit 140, the first input switching circuit 142, the third input switching circuit 144, and the fourth input switching circuit 145 are in the OFF state, in the slave board 1. At this time, the first reference voltage VREFA supplied from the master board 2 in the first connection line 511 through the second input switching circuit 143 of the second path becomes the supply voltage VS1. In the master board 2, the first output switching circuit 240 and the first input switching circuit 242 are in the ON state while the second input switching circuit 243, the third input switching circuit 244, and the fourth input switching circuit 245 are in the OFF state. At this time, the first reference voltage VREFA supplied through the first input switching circuit 242 and the fourth input-side resistor 255 of the first path becomes the supply voltage VS2. In the slave board 3, the third input switching circuit 344 is in the ON state while the first output switching circuit 340, the first input switching circuit 342, the second input switching circuit 343, and the fourth input switching circuit 345 are in the OFF state. At this time, the reference voltage VREFB supplied from the master board 2 in the fifth connection line 522 through the third input switching circuit 344 and the fifth input-side resistor 356 of the third path becomes the supply voltage VS3. In the slave board 4, the fourth input switching circuit 445 is in the ON state while the first output switching circuit 440, the first input switching circuit 442, the second input switching circuit 443, and the third input switching circuit 444 are in the OFF state. At this time, the reference voltage VREFB supplied from the master board 2 in the fifth connection line 522 and the sixth connection line 532 through the fourth input switching circuit 445 of the fourth path becomes the supply voltage VS4. The supply voltages VS1, VS2, VS3 and VS4 become equal as explained below, by the voltage drop in the connection lines, the output-side resistors, and the input-side resistors. The consumption current in each of the gradation voltage generation circuits is represented by I. The current flowing to the resistors and the connection lines is assumed to be 21 in the output-side resistor 254, I in the fourth input-side resistor 255, I in the first connection line 511, 21 in the fifth connection line 522, I in the fifth input-side resistor 356, and I in the sixth connection line 532.

$$VS1=VDD2-2I\times R4-I\times R51=VDD2-I\times R51-2\times I\times R52$$

$$VS2=VDD2-2I\times R4-I\times R5=VDD2-I\times R51-2\times I\times R52$$

$$VS3=VDD2-2I\times R52-I\times R6=VDD2-I\times R51-2\times I\times R52$$

$$VS4=VDD2-2I\times R52-I\times R53=VDD2-I\times R51-2\times I\times R52$$

For example, the supply voltages become as follows if VDD2 is 12[V], R4 and R52 are equally 1 [Ω], R5, R6, R51 and R53 are equally 3[Ω], and I is 0.02 [A].

$$VS1=VS2=VS3=VS4=12-0.02\times 0.3-2\times 0.02\times 1=11.954[V]$$

According to the display device DSP of the above-explained modified example, the resistance values of the output-side resistors and the input-side resistors can be made smaller.

Figure 10:
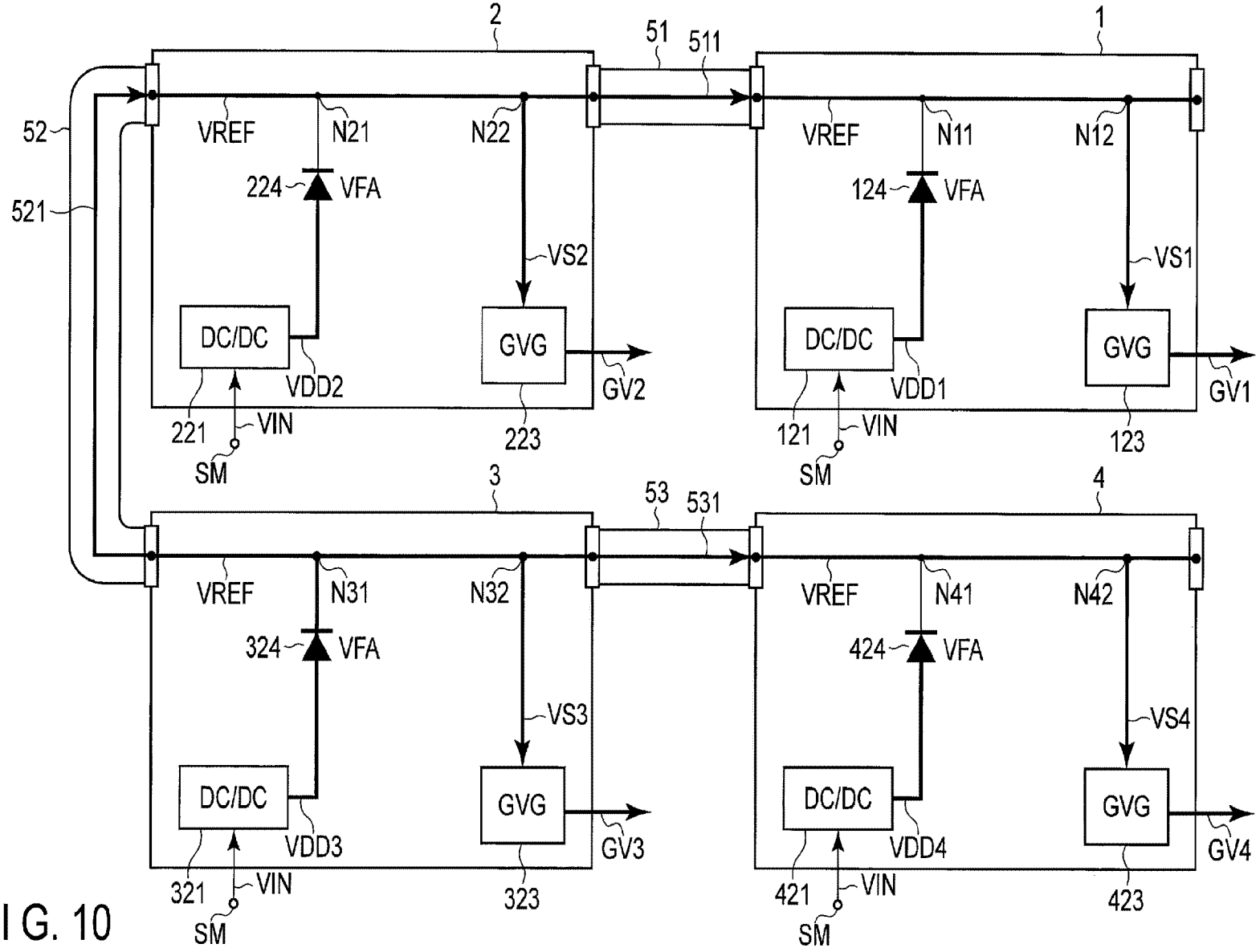
FIG. 10 is a diagram showing a circuit board and its circuit configuration example, of the display device according to a third modified example.

FIG. 10 shows a circuit board and its circuit configuration example, of the display device of the third modified example. The present modified example is different from the first embodiment with respect to a feature of comprising not the output switching circuit, but a diode 124 connected in a forward direction from the power supply circuit 121 toward the first node N11, on the circuit which connects the power supply circuit 121 and the first node N11, on the first circuit board 1. In addition, in the present modified example, the second node N12 and the gradation voltage generation circuit 123 are connected to each other via no input switching circuit. Each of the second circuit board 2, the third circuit board 3 and the fourth circuit board 4 has the same circuit configuration as the first circuit board 1. Therefore, the second circuit board 2 similarly includes a diode 224 connected in a forward direction from the power supply circuit 221 toward the first node N21. The third circuit board 3 similarly includes a diode 224 connected in a forward direction from the power supply circuit 321 toward the first node N31. The fourth circuit board 4 similarly includes a diode 224 connected in a forward direction from the power supply circuit 421 toward the first node N41.

In the power supply circuits 121, 221, 321 and 421, a potential error occurs in the output power source voltages, due to irregularity in performance, as shown in FIG. 7. The circuit board including the power supply circuit which outputs the highest power source voltage, of the power source voltages VDD1, VDD2, VDD3 and VDD4, functions as the master board, and the other circuit boards function as the slave boards. In other words, the master board is not selected in accordance with the addresses (PCB_ADD=0, 1, 2, and 3) allocated to the respective circuit boards, unlike the first embodiment, the first modified example or the second modified example, but the master board is automatically determined in accordance with the magnitude of the power source voltages.

In the example illustrated, the master board is the third circuit board 3. On the master board 3, the power source voltage VDD3 output from the power supply circuit 321 is supplied to the first node N31 through the diode 324, as the reference voltage VREF. The potential of the reference voltage VREF is VDD3−VFA obtained by subtracting a voltage drop VFA of the diode 324 from the power source voltage VDD3. The reference voltage VREF is supplied to the gradation voltage generation circuit 323 through the third node N32. The reference voltage VREF is also supplied to the gradation voltage generation circuits 123, 223 and 423 arranged on the respective slave boards.

At this time, for example, when a gradation voltage GV4 is generated on the slave board 4, the supply of the power source voltage VDD4 through the diode 424 is interrupted. In other words, a reverse-bias or forward-bias voltage difference smaller than the voltage drop VFA is applied to the diode 424.

In the display device DSP of the modified example, the components of each circuit board can be reduced and the manufacturing costs can be reduced.

Next, the second embodiment will be explained with reference to FIG. 11 to FIG. 12.

Figure 11:
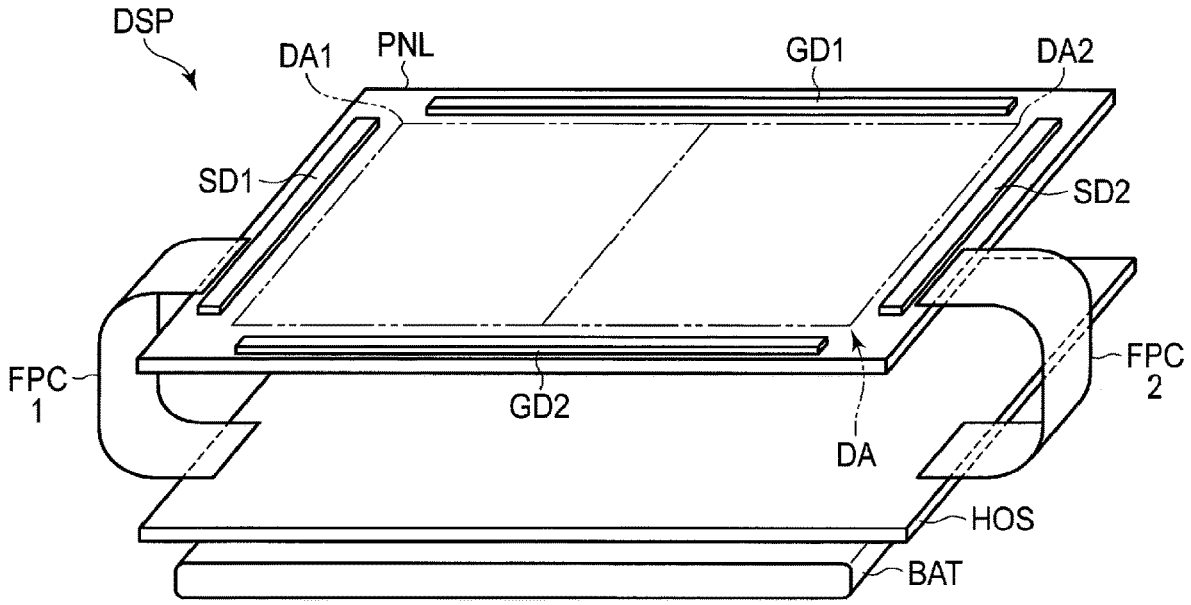
FIG. 11 is an illustration showing a summary of a display device in the divisional drive system including two divided display areas, according to a second embodiment.

FIG. 11 is an illustration showing a summary of a display device DSP in the divisional drive system including two divided display areas, according to the second embodiment.

A display panel PNL is opposed to a host device HOS, and the host device HOS is opposed to a battery BAT. The host device HOS is located on a back surface of the display panel PNL, between the display panel PNL and the battery BAT. On the display panel PNL, the side on which the display area DA is located is referred to as a top surface, and the side opposite to the top surface is referred to as the back surface. The battery BAT is connected to the host device HOS to supply a drive voltage though not shown.

For example, the display panel PNL is in a rectangular shape. The display panel PNL includes in a non-display area NDA a first scanning line driver GD1, a second scanning line driver GD2, a first signal line driver SD1, and a second signal line driver SD2. In the example illustrated, the first scanning line driver GD1 and the second scanning line driver GD2 are arranged along longer sides of the display panel PNL and opposed to each other to sandwich the display area DA. The first signal line driver SD1 and the second signal line driver SD2 are arranged along shorter sides of the display panel PNL and opposed to each other to sandwich the display area DA. The display panel PNL is connected to the host device HOS via a first flexible printed circuit FPC1, for example, on the shorter side on which the first signal line driver SD1 is arranged. The display panel PNL is also connected to the host device HOS via a second flexible printed circuit FPC2, on the shorter side on which the second signal line driver SD2 is arranged.

The rectangular display area DA includes a first divided display area DA1 and a second divided display area DA2. A boundary between the first divided display area DA1 and the second divided display area DA2 divides the display area DA into two areas in the longer-side direction. The first divided display area DA1 is adjacent to the first scanning line driver GD1, the second scanning line driver GD2, and the first signal line driver SD1. The second divided display area DA2 is adjacent to the first scanning line driver GD1, the second scanning line driver GD2, and the second signal line driver SD2. The first divided display area DA1 is supplied with a data signal from the first signal line driver SD1. The second divided display area DA2 is supplied with a data signal from the second signal line driver SD2.

Figure 12:
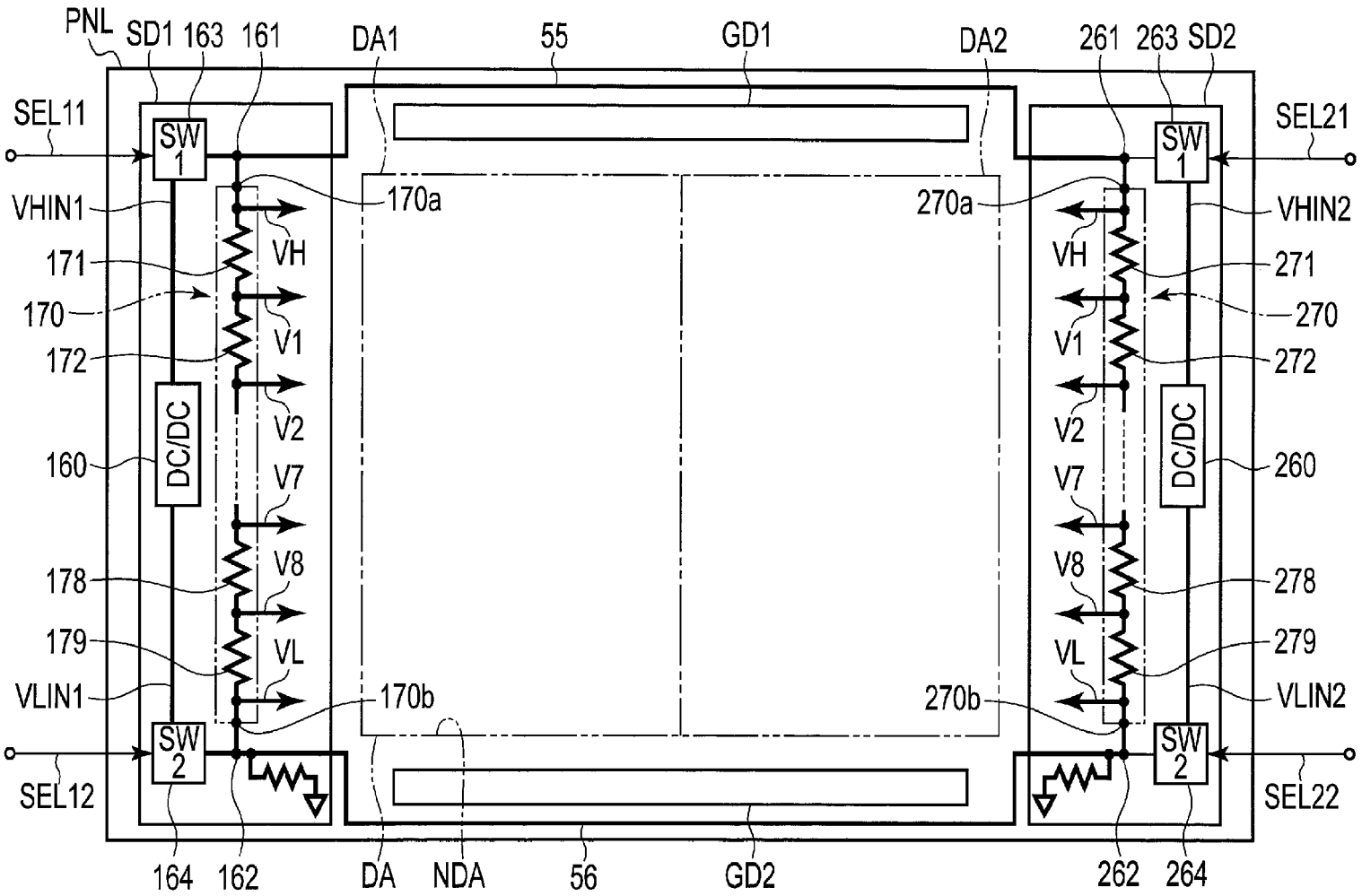
FIG. 12 is a diagram showing a circuit board and its circuit configuration example, of the display device according to the second embodiment.

FIG. 12 is a diagram showing a circuit board and its circuit configuration example, of the display device according to the second embodiment.

The first signal line driver SD1 comprises, for example, at least some of the functions of the illustrated circuit boards of the first embodiment. In the example illustrated, the first signal line driver SD1 comprises a power supply circuit (DC/DC) 160 and a gradation voltage generation circuit 170. The power supply circuit 160 is connected to an end 170*a* of the gradation voltage generation circuit 170 via a first output switching circuit (SW1) 163. The power supply circuit 160 is connected to another end 170*b* of the gradation voltage generation circuit 170 via a second output switching circuit (SW2) 164. A first node 161 exists on a circuit which connects the first output switching circuit 163 and the end 170*a* to each other, and a second node 162 exists on a circuit which connects the second output switching circuit 164 and the end 170*b* to each other. A first connection line 55 extends from the first node 161, and a second connection line 56 extends from the second node 162. The gradation voltage generation circuit 170 is, for example, a ladder resistor and comprises nine resistors 171 to 179 arranged in order from the end 170*a*.

The first output switching circuit 163 controls supply of the voltage from the power supply circuit 160 to the end 170*a* in response to a control signal SEL11 supplied from the outside of the first signal line driver SD1. The second output switching circuit 164 controls supply of the voltage from the power supply circuit 160 to the end 170*b* in response to a control signal SEL12 supplied from the outside of the first signal line driver SD1. The control signals SEL11 and SEL12 are supplied from, for example, the host device HOS shown in FIG. 11 via the first flexible printed circuit FPC1.

It has been explained above that the power supply circuit (DC/DC) 160, the gradation voltage generation circuit 170, and the output switching circuits (SW1) 163 and (SW2) 164 are configured integrally with the signal line driver SD1 but, of course, the circuits may be provided on different circuit boards.

The second signal line driver SD2 has the same circuit configuration as the first signal line driver SD1. In other words, a power supply circuit 260 is connected to an end 270*a* of a gradation voltage generation circuit 270 via a first output switching circuit (SW1) 263, the power supply circuit 260 is connected to another end 270*b* of the gradation voltage generation circuit 270 via a second output switching circuit (SW2) 264, a first node 261 exists on a circuit which connects the first output switching circuit 263 and the end 270*a* to each other, and a second node 262 exists on a circuit which connects the second output switching circuit 264 and the end 270*b* to each other, the first connection line 55 extends from the first node 261, and the second connection line 56 extends from the second node 262. The gradation voltage generation circuit 270 is, for example, a ladder resistor and comprises nine resistors 271 to 279 arranged in order from the end 270*a*. A control signal SEL21 is supplied to the first output switching circuit 263 and a second control signal SEL22 is supplied to the second output switching circuit 264, from, for example, the host device HOS shown in FIG. 11 via the second flexible printed circuit FPC2.

The first connection line 55 is provided on the display panel PNL to make connection between the first node 161 and the first node 261. The first connection line 55 is arranged on an outer side of the first scanning line driver GD1 in the non-display area NDA. The second connection line 56 is provided on the display panel PNL to make connection between the second node 162 and the second node 262. The second connection line 56 is arranged on an outer side of the second scanning line driver GD2 in the non-display area NDA. For example, the first connection line 55 and the second connection line 56 are formed of the same material, in the same layer, as the scanning lines G or the signal lines D.

Next, operations of the first signal line driver SD1 and the second signal line driver SD2 at the generation of the gradation voltages will be explained. The first signal line driver SD1 is assumed to function as the master driver while the second signal line driver SD2 is assumed to function as the slave driver. The first signal line driver SD1 and the second signal line driver SD2 comprise, for example, mode terminals (not shown), and the master driver is selected by a select signal input from either of the mode terminals. The mode terminals are connected to the host device HOS, and the master driver is arbitrarily selected by the select signal output from the host device HOS. Alternatively, the master driver may be determined preliminarily.

The first output switching circuit 163 and the second output switching circuit 164 provided in the master driver SD1 are turned on while the first output switching circuit 263 and the second output switching circuit 264 provided in the slave driver SD2 are turned off. The power supply circuit 160 provided in the master driver SD1 outputs a first reference voltage VHIN1 and a second reference voltage VLIN1. The first reference voltage VHIN1 is supplied to the end 170*a* through the first output switching circuit 163. The first reference voltage VHIN1 supplied through the first output switching circuit 163 is also supplied to the end 270*a* of the gradation voltage generation circuit 270 provided in the slave driver SD2, in the first connection line 55. The second reference voltage VLIN1 is supplied to the end 170*b* through the second output switching circuit 164. The second reference voltage VLIN1 supplied through the second output switching circuit 164 is also supplied to the end 270*b* of the gradation voltage generation circuit 270 provided in the slave driver SD2, in the second connection line 56. A first reference voltage VHIN2 and a second reference voltage VLIN2 which are output from the power supply circuit 260 provided in the slave driver SD2 are interrupted by the first output switching circuit 263 and the second output switching circuit 264.

In the gradation voltage generation circuit 170, an output voltage of potential VH is output from between the end 170*a* and the resistor 171. Output voltages of potentials V1 to V8 are output from between the resistors 172 to 179. An output voltage of potentials VH is output from between the resistor 179 and the end 170*b*. In the gradation voltage generation circuit 270, the voltage supplied to the end 270*a* is equal to the voltage supplied to the end 170*a* of the gradation voltage generation circuit 170, and the voltage supplied to the end 270*b* is equal to the voltage supplied to the end 170*b* of the gradation voltage generation circuit 170. The reference values of the resistors 271 to 279 provided in the gradation voltage generation circuit 270 are equal to the reference values of the resistors 171 to 179 provided in the gradation voltage generation circuit 170. Therefore, the output voltages of the potentials VH, VL, and V1 to V8 are also output from the gradation voltage generation circuit 270. Since the potentials of the output voltages are higher in order of VH, V1, V8, and VL, the amplitude of the drive voltage of the pixel electrode PE can be changed within the range between VH and VL.

According to the present embodiment, the first reference voltage VHIN1 is supplied to all the ends 170*a* and 270*a* and the second reference voltage VLIN1 are supplied to all the ends 170*b* and 270*b*, from the power supply circuit 160 provided in the master driver SD1. Since the potentials of the drive amplitudes in the first divided display area DA1 and the second divided display area DA2 become at the same level, the difference in level of luminance and the non-uniformity in display can be suppressed in the display device DSP. In other words, according to the present embodiment, the high-definition display device DSP capable of improving the display quality can be provided.

Figure 13:
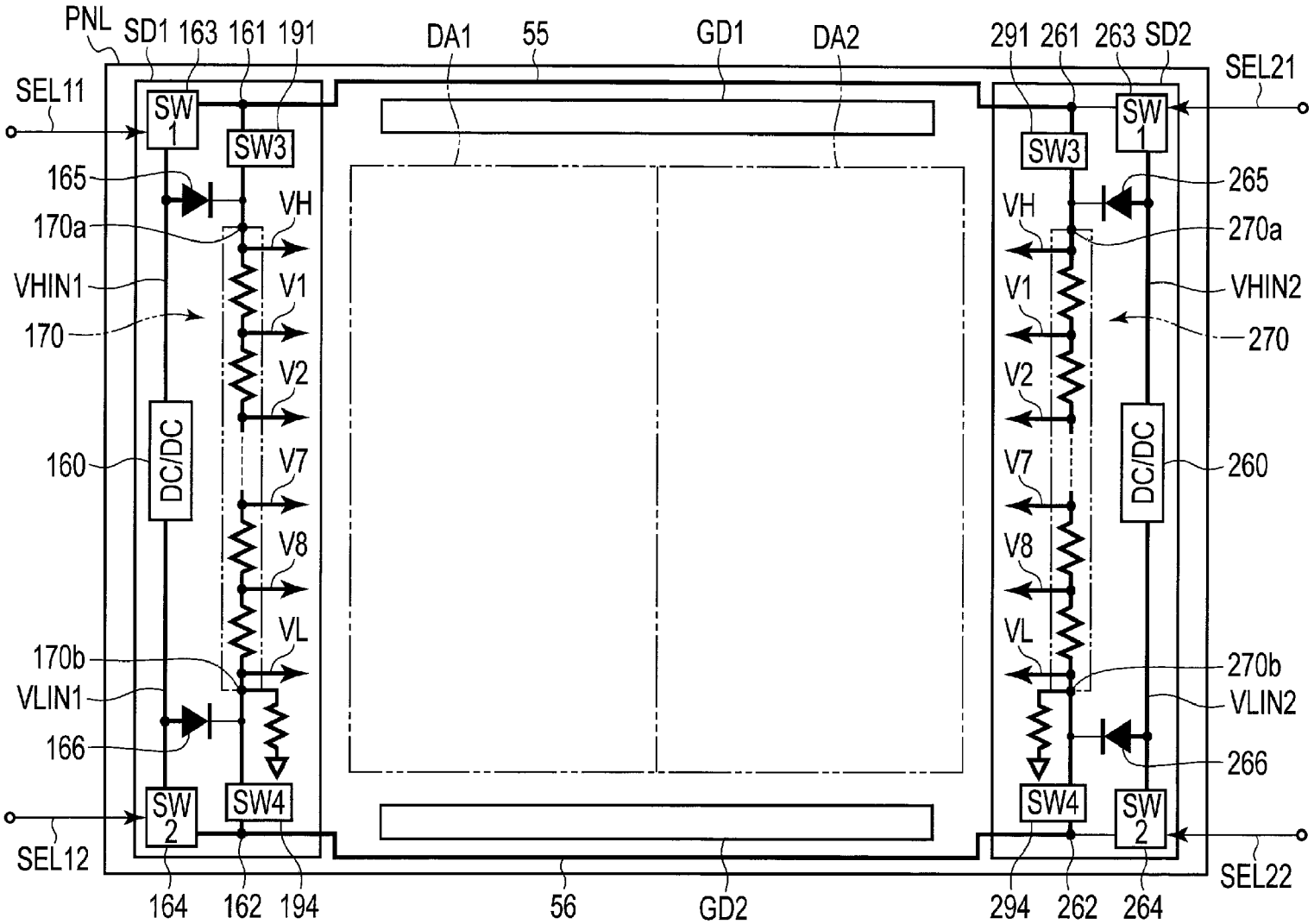
FIG. 13 is a diagram showing a circuit board and its circuit configuration example, of the display device according to a fourth modified example.

Next, a modified example of the second embodiment will be explained with reference to FIG. 13 to FIG. 15. It should be noted that the same advantages as those of the second embodiment can be obtained from fourth to sixth modified examples to be explained below. FIG. 13 is a diagram showing a circuit board and its circuit configuration example, of the display device according to a fourth modified example. The present modified example is different from the second embodiment with respect to a feature of providing a first input switching circuit (SW3) 191, a second input switching circuit (SW4) 194, a first diode 165, and a second diode 166, in the first signal line driver SD1. The fourth modified example is characterized by canceling the shift of output timing of the gradation voltages output from the gradation voltage generation circuits 170 and 270 when generation of the gradation voltages is started.

The first input switching circuit 191 is arranged on a circuit which connects the first node 161 and the end 170*a*. The second input switching circuit 194 is arranged on a circuit which connects the second node 162 and the end 170*b*. The first diode 165 is connected parallel to the first output switching circuit 163 and the first input switching circuit 191, and connected in a forward direction from the power supply circuit 160 to the end 170*a*. The second diode 166 is connected parallel to the second output switching circuit 164 and the second input switching circuit 194, and connected in a forward direction from the power supply circuit 160 to the end 170*b*.

The second signal line driver SD2 also has the same circuit configuration as the first signal line driver SD1. The second signal line driver SD2 comprises a first input switching circuit (SW3) 291, a second input switching circuit (SW4) 294, a first diode 265, and a second diode 266.

In the first signal line driver SD1 serving as the master driver, an auxiliary voltage is supplied from the power supply circuit 160 to the end 170*a* through the first diode 165 before generation of the gradation voltage. In addition, an auxiliary voltage is supplied from the power supply circuit 160 to the end 170*b* through the second diode 166. The potential of each auxiliary voltage is lower than the first reference voltage VHIN1 and the second reference voltage VLIN1 due to an influence of the voltage drop at the first diode 165 and the second diode 166. In the second signal line driver SD2 serving as the slave driver, an auxiliary voltage is supplied from the power supply circuit 260 to the end 270*a* through the first diode 265 and an auxiliary voltage is supplied from the power supply circuit 260 to the end 270*b* through the second diode 266. In the slave driver SD2, too, the potential of each auxiliary voltage is lower than the first reference voltage VHIN2 and the second reference voltage VLIN2. It should be noted that the output switching circuits and the input switching circuits provided at all the signal line drivers are in the OFF state.

After the outputs of the power supply circuit 160 and 260 become stable and the outputs of the gradation voltages become stable, the first output switching circuit 163 and the second output switching circuit 164 of the master driver SD1 are turned on. Then, the first input switching circuits 191 and 291, and the second input switching circuits 194 and 294 are simultaneously turned on. For example, switching of the first input switching circuits and the second input switching circuits is executed based on the control signal SEL11 and the control signal SEL12 of the master driver, at timing delayed by a certain time from the control signal SEL11 or the control signal SEL12. The first reference voltage VHIN1 and the second reference voltage VLIN2 are therefore simultaneously supplied to the gradation voltage generation circuit 170 and the gradation voltage generation circuit 270, respectively. In other words, generation of the gradation voltages is started.

When supply of the first reference voltage VHIN1 and the second reference voltage VLIN1 to the gradation voltage generation circuit 170 through the first input switching circuit 191 and the second input switching circuit 194 is started, in the master driver SD1, the potential differences between the output terminals and the input terminals at the first diode 165 and the second diode 166 become lower than the threshold voltages at the first diode 165 and the second diode 166. The supply of the auxiliary voltages to the gradation voltage generation circuit 170 through the first diode 165 and the second diode 166 is therefore interrupted. In the slave driver SD2, too, when the supply of the first reference voltage VHIN1 and the second reference voltage VLIN1 to the gradation voltage generation circuit 270 is started, supply of the auxiliary voltages to the gradation voltage generation circuit 270 through the first diode 265 and the second diode 266 is interrupted.

As explained above, the timing of supplying the first reference voltage VHIN1 to the gradation voltage generation circuits 170 and 270 can be controlled by the first input switching circuits 191 and 291, in the present modified example. The timing of supplying the second reference voltage VLIN1 can also be controlled in the similar manner. Thus, according to the present modified example, the timing of outputting the gradation voltages to the respective gradation voltage generation circuits 170 and 270 can be made to correspond to each other, and a disturbance of display images on the first divisional display area DA1 and the second divisional display area DA2 can be suppressed. In addition, occurrence of the latch-up can be suppressed since the outputs of the gradation voltage generation circuits become stable by supplying the auxiliary voltages before the start of generation of the gradation voltages.

Figure 14:
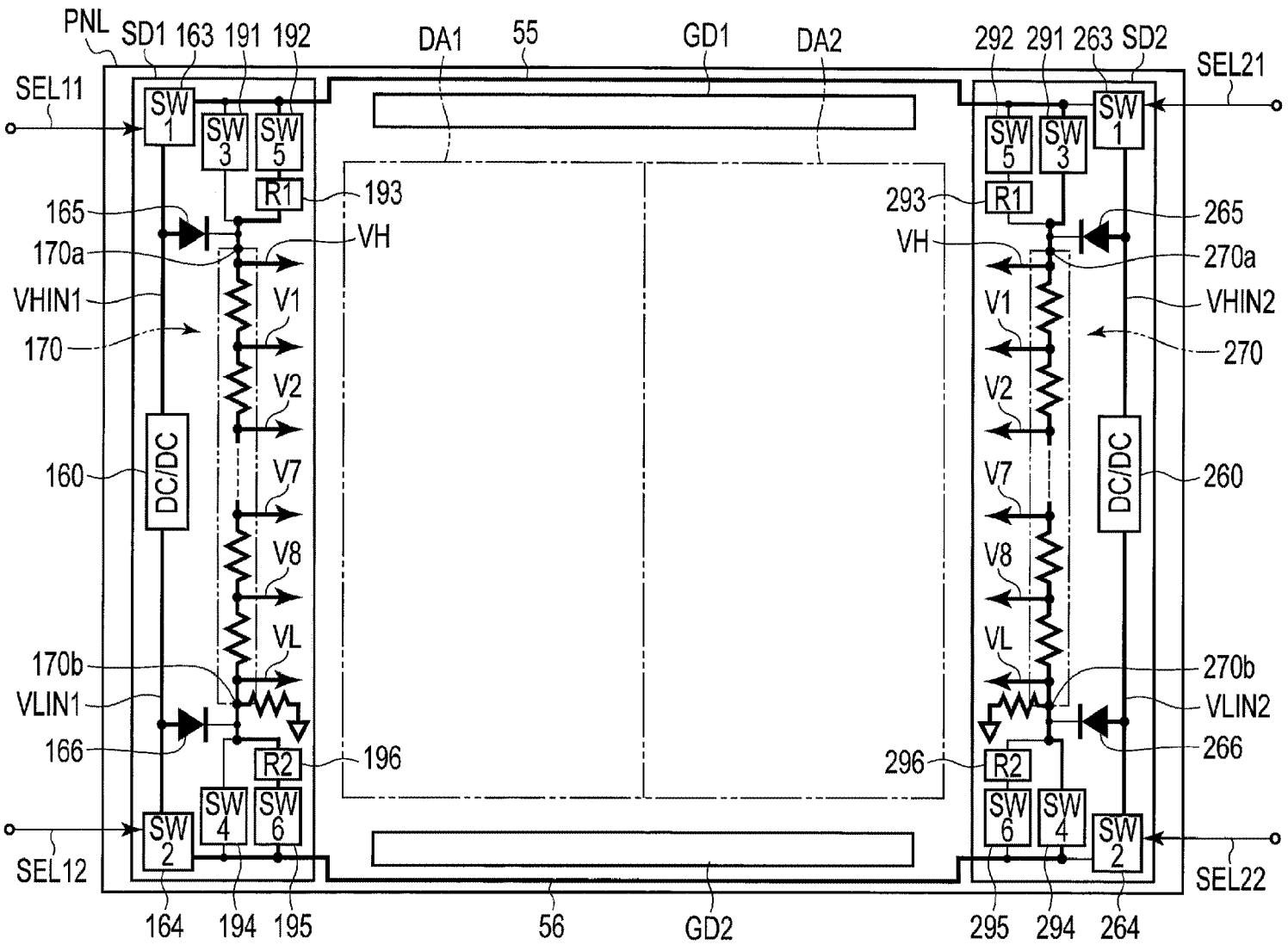
FIG. 14 is a diagram showing a circuit board and its circuit configuration example, of the display device according to a fifth modified example.

FIG. 14 is a diagram showing a circuit board and its circuit configuration, of the display device according to the fifth modified example. The present modified example is different from the fourth modified example with respect to a feature of providing a first input switching circuit (SW5) 192, a first resistor 193, a second input switching circuit (SW6) 195, and a second resistor 196, in the first signal line driver SD1. Reduction of an influence from the line resistance of the first connection line 55 and the second connection line 56 is considered in the present modified example.

The first input switching circuit 192 is connected to the first output switching circuit 163 and the end 170*a*, and connected parallel to the first input switching circuit 191. The first resistor 193 is assumed to be connected serially with the first input switching circuit 192 and have a resistance equal to the resistance of the first connection line 55. The second input switching circuit 195 is connected to the second output switching circuit 164 and the end 170*b*, and connected parallel to the second input switching circuit 194. The second resistor 196 is assumed to be connected serially with the second input switching circuit 195 and have a resistance equal to the resistance of the second connection line 56.

The second signal line driver SD2 also has the same circuit configuration as the first signal line driver SD1. The second signal line driver SD2 comprises a first input switching (SW5) circuit 292 connected parallel to the first input switching circuit 291, a first resistor 293 connected serially to the first input switching circuit 292, a second input switching circuit (SW6) 295 connected parallel to the second input switching circuit 294, and a second resistor 296 connected serially to the second input switching circuit 295.

When the gradation voltages are generated, the first output switching circuit 163 and the second output switching circuit 164 in the first signal line driver (master driver) SD1 are turned on while the first output switching circuit 263 and the second output switching circuit 264 in the second signal line driver (slave driver) SD2 are maintained in the OFF state. The first input switching circuits 191 and 292 are turned off, and the first input switching circuits 192 and 291 are turned on. The second input switching circuits 194 and 295 are turned off, and the second input switching circuits 195 and 294 are turned on. The first reference voltage VHIN1 output from the power supply circuit 160 provided in the master driver SD1 is supplied to the end 170*a* of the gradation voltage generation circuit 170 provided in the master driver SD1, through the first output switching circuit 163, the first input switching circuit 192 and the first resistor 193. The first reference voltage VHIN1 output from the power supply circuit 160 is also supplied to the end 270*a* of the gradation voltage generation circuit 270 provided in the slave driver SD2, through the first output switching circuit 163, the first connection line 55 and the first input switching circuit 192. Since the resistance value R1 which the first resistors 193 and 293 have is equal to the line resistance of the first connection line 55, the first reference voltage VHIN1 is subjected to the voltage drop in the path of being supplied to the end 170*a* and the path of being supplied to the end 270*a* at the same level. Thus, the resistance values of the resistors are selected such that the voltages supplied to the gradation voltage generation circuits become approximately equivalent to each other in response to impedances of the respective connection lines.

Similarly, the second reference voltage VLIN1 output from the power supply circuit 160 provided in the master driver SD1 is supplied to the end 170*b* of the gradation voltage generation circuit 170 provided in the master driver SD1, through the second output switching circuit 164, the second input switching circuit 195 and the second resistor 196. The second reference voltage VLIN1 output from the power supply circuit 160 is also supplied to the end 270*b* of the gradation voltage generation circuit 270 provided in the slave driver SD2, through the second output switching circuit 164, the second connection line 56 and the second input switching circuit 294. Since the resistance value R2 which the second resistors 196 and 296 have is equal to the line resistance of the second connection line 56, the second reference voltage VLIN1 is subjected to the voltage drop, equally, in the path of being supplied to the end 170*b* and the path of being supplied to the end 270*b*.

According to the above-explained modified example, the shift of potential levels of the gradation voltages between the master driver SD1 and the slave driver SD2, which results from the line resistances of the first connection line 55 and the second connection line 56, can be suppressed in the display device DSP. In other words, according to the display device DSP of the present modified example, the display quality can be further improved.

Figure 15:
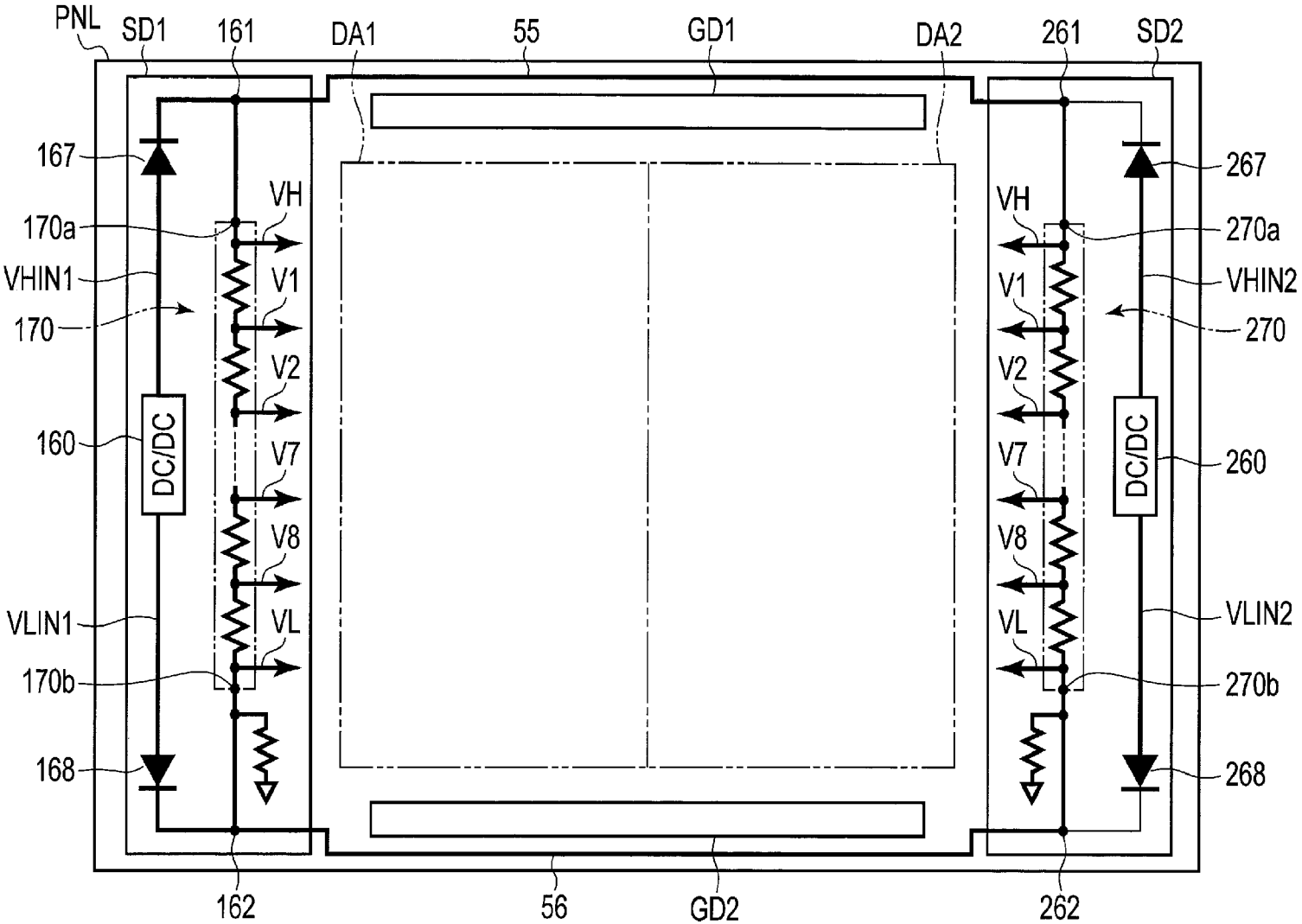
FIG. 15 is a diagram showing a circuit board and its circuit configuration example, of the display device according to a sixth modified example.

FIG. 15 is a diagram showing a circuit board and its circuit configuration example, of the display device according to the sixth modified example. The present modified example is different from the second embodiment with respect to a feature of providing a third diode 167 instead of the first output switching circuit 163 and comprising a fourth diode 168 instead of the second output switching circuit 164, in the first signal line driver SD1. The third diode 167 is connected in a forward direction from the power supply circuit 160 toward the first node 161. The fourth diode 168 is connected in a forward direction from the power supply circuit 160 toward the second node 162. The second signal line driver SD2 also has the same circuit configuration as the first signal line driver SD1. In other words, the second signal line driver SD2 comprises a third diode 267 connected in a forward direction from the power supply circuit 260 toward a first node 261, and a fourth diode 268 connected in a forward direction from the power supply circuit 260 toward a second node 262.

Each of the first reference voltage VHIN1 and the first reference voltage VHIN2 includes a potential error due to the tolerance of performance of the performance of the power supply circuit. Similarly, each of the second reference voltage VLIN1 and the second reference voltage VLIN2 also includes a potential error. The voltage having a higher potential, of the first reference voltage VHIN1 and the first reference voltage VHIN2, is supplied to both the ends 170*a* and 270*a*. The voltage having a higher potential, of the second reference voltage VLIN1 and the second reference voltage VLIN2, is supplied to both the ends 170*b* and 270*b*. In other words, the master driver is selected not preliminarily, but automatically.

In the display device DSP of the modified example, the components of each signal line drivers can be reduced and the manufacturing costs can be reduced.

In all the embodiments and the modified examples, the difference in level of luminance and the non-uniformity in display in the display device DSP can be suppressed without supplying different common voltages to the common electrodes provided in the respective divided display areas, since the shift of the gradation voltages can be suppressed. The display device DSP may comprise a common electrode CE formed to extend over a plurality of divided display areas. Such a common electrode CE is opposed to a plurality of pixel electrodes and supplied with common voltages of the same potential in the divided display areas. In the display device DSP, the structure can be simplified and the manufacturing costs can be suppressed while maintaining the display quality.

As the definition becomes higher, necessity of the divisional drive to divide and drive the display areas is increased and the embodiments are preferably applicable to the display device DSP. Furthermore, as the drive speed becomes higher, necessity of the divisional drive is increased and the embodiments are preferably applicable to the display device DSP. For example, if the image resolution exceeds FHD (1920×1080) or a double-speed drive is executed for the frame frequency, the display device DSP of the first embodiment or the second embodiment can be preferably used.

The number of the divided display areas is not particularly limited in the embodiments. If the display area is divided into at least two areas, the display device DSP of the first embodiment or the second embodiment can be preferably used. The display device is designed in a landscape orientation in FIG. 13 and FIG. 14, but may be rotated at 90° when used. Furthermore, the display device may be configured to include a display area of a portrait orientation.

The embodiments include various elements and can be described below.

(1) A display device, comprising: a display panel PNL which includes divided display areas DA1, DA2, DA3 and DA4 and allows an image to be displayed in a display area DA surrounded by a non-display area NDA; signal line drivers SD1, SD2, SD3 and SD4 which supply corresponding data signals to the divided display areas, respectively; circuit boards 1, 2, 3 and 4 which supply gradation voltages GV1, GV2, GV3 and GV4 for generation of the data signals to the signal line drivers; power supply circuits 121, 221, 321 and 421 provided on the respective circuit boards; gradation voltage generation circuits 123, 223, 323 and 423 provided on the respective circuit boards and connected to the corresponding power supply circuits; a master board 2 selected from the circuit boards; and reference voltage supply systems 511, 521 and 531 which supply a reference voltage VREF from the power supply circuit 221 provided on the master board to the gradation voltage generation circuits in all the circuit boards.

(2) The display device of (1) further comprising switching circuits SW2 connected to reference voltage input members of the gradation voltage generation circuits 123, 223, 323 and 423, respectively, wherein the switching circuits SW2 are simultaneously turned on after outputs of the power supply circuits 121, 221, 321 and 421 rise.

(3) The display device of (1), wherein paths are formed between reference voltage input members of the gradation voltage generation circuits 123, 223, 323 and 423 and the power supply circuit 221 of the master board 2, on the respective circuit boards 1, 2, 3 and 4, the paths are different from each other with respect to resistance values, the paths include switching circuits SW3, SW4, SW5 and SW6, respectively, and the switching circuit SW2 of the path selected in response to impedances of the reference voltage supply systems 511, 521 and 531 between the gradation voltage generation circuits and the power supply circuit of the master board is controlled to be turned on.

(4) The display device of (1), wherein the reference voltage supply systems include supply systems of a first reference voltage VREFA and a second reference voltage VREFB, the reference voltage from the power supply circuit 221 in the master board 2 is branched to the first reference voltage supply systems 511, 521 and 531 and the second reference voltage supply systems 512, 522 and 532, which are different in resistance value, and the reference voltage VREFB from the reference voltage supply systems 512, 522 and 532 having a lower resistance value is used in the circuit boards remote from the master board.

(5) The display device of (1), wherein the power supply circuits 121, 221, 321 and 421 provided on the circuit boards are connected in a forward direction to the reference voltage supply systems via diodes 124, 224, 324 and 424, respectively.

(6) The display device of (1), wherein the power supply circuits 121, 221, 321 and 421 provided on the circuit boards are connected to the reference voltage supply systems via switching circuits SW1.

(7) A display device, comprising: a display panel PNL which includes first and second divided display areas DA1 and DA2 and allows an image to be displayed in a display area DA surrounded by a non-display area NDA; first and second circuits SD1 and SD2 which includes gradation voltage generation circuits 170 and power supply circuits 160 and 260, respectively, which generate data signals to be supplied to the first and second divided display areas, based on gradation voltages output from the gradation voltage generation circuits, and which include switching circuits (SW1) 163 and 263 between the power supply circuits and the gradation voltage generation circuits, wherein a voltage supply terminal 170*a* of the gradation voltage generation circuit 170 of the first circuit and a voltage supply terminal 270*a* of the gradation voltage generation circuit of the second circuit are connected to each other via a reference voltage supply system 55, the first circuit serves as a master circuit, the second circuit serves as a slave circuit, the switching circuit 163 of the master circuit is turned on, the switching circuit 263 of the slave circuit is turned off, and a power source voltage VHIN1 output from the power supply circuit 160 of the first circuit is used for generation of the gradation voltages of the gradation voltage generation circuits of the first and second circuits.

(8) The display device of (7) further comprising switching circuits SW3 connected to the reference voltage supply terminals 170*a* and 270*a* of the first and second gradation voltage generation circuits, wherein the switching circuits SW3 are simultaneously turned on after outputs of the first and second power supply circuits rise.

(9) The display device of (7) further comprising a first switching circuit SW3 and a second switching circuit SW5 connected to the respective reference voltage supply terminals 170*a* and 270*a* of the first and second gradation voltage generation circuits, wherein in the first and second circuits, a first path is formed for the first switching circuit SW3, a second path having a resistance value different from the first path is formed for the second switching circuit SW5, and the resistance value of the second path is selected in accordance with an impedance of the connection line 55 between the power supply circuit 160 of the first circuit and the second circuit.

(10) The display device of (7), wherein the reference voltage supply system 55 includes first and second supply systems, a reference voltage VHIN1 output from the power supply circuit 160 in the first circuit SD1 is branched to the first reference voltage supply system and the second reference voltage supply system, which are different in resistance value, and a reference voltage from the reference voltage supply system having a lower resistance value is used in the second circuit SD2.

(11) The display device of (8), further comprising a first diode 165 and a second diode 166 connected parallel to the switching circuits SW3 provided in the respective first and second circuits.

(12) The display device of (7), wherein each of the first and second power supply circuits 160 and 260 provided in the respective first and second circuits is connected to the reference voltage supply system 55 via the switching circuit SW1.

According to the embodiments, as described above, the high-definition display device capable of improving the display quality can be provided.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A display device, comprising:

a display panel which includes divided display areas and allows an image to be displayed in a display area surrounded by a non-display area;

signal line drivers which are arranged in the non-display area, include a master driver, and supply corresponding data signals to the divided display areas, respectively;

gradation voltage generation circuits each provided on each of the signal line drivers;

power supply circuits each connected to an end of each of the gradation voltage generation circuits;

nodes each existing on each circuit connecting each of the power supply circuits and each of the ends;

a connection line which connects the nodes to each other; and diodes each arranged on the circuit connecting the power supply circuit and the node, and connected in a forward direction from the power supply circuit toward the node, the power supply circuit provided on the master driver supplying a reference voltage to all the ends via the diode, the gradation voltage generation circuits generating gradation voltages based on the reference voltage.

2. The display device of claim 1, wherein the display panel includes:

signal lines connected to the signal line drivers and arranged parallel to the display area; and scanning lines arranged parallel to the display area to intersect the signal lines, and the connection line is formed of a same material in a same layer as the signal lines or the scanning lines.

3. The display device of claim 1, wherein all the signal line drivers have a same circuit configuration.

4. The display device of claim 1, wherein a drive frequency of the display panel is equal to or higher than 120 Hz.

5. A display device, comprising:

a display panel which includes divided display areas and allows an image to be displayed in a display area surrounded by a non-display area;

signal line drivers which supply corresponding data signals to the divided display areas, respectively;

circuit boards which include a master board and supply gradation voltages for generation of the data signals to the signal line drivers;

a power supply circuit provided on each of the circuit boards;

a gradation voltage generation circuit provided on each of the circuit boards and connected to the power supply circuit; and at least one connection line which connects the circuit boards to each other, all the gradation voltage generation circuits generating the gradation voltages corresponding to a reference voltage supplied from the power supply circuit provided on the master board, each of the circuit boards including:

a first node existing on a circuit connected to the connection line;

a diode arranged on a circuit connecting the power supply circuit and the first node to each other and connected in a forward direction from the power supply circuit toward the first node; and a second node existing on a circuit connecting the diode and the connection line to each other and connected to the gradation voltage generation circuit, the reference voltage being supplied through the diode on the master board.

6. The display device of claim 5, wherein the connection lines and the circuit boards are alternately connected, and two connection lines of the connection lines are connected to the master board.

7. The display device of claim 5, wherein all the circuit boards have a same circuit configuration.

8. The display device of claim 6, wherein all the circuit boards have a same circuit configuration.

9. A display device, comprising:

a display panel which includes divided display areas and allows an image to be displayed in a display area surrounded by a non-display area;

signal line drivers which are arranged in the non-display area, include a master driver, and supply corresponding data signals to the divided display areas, respectively;

gradation voltage generation circuits each provided on each of the signal line drivers;

power supply circuits each connected to an end of each of the gradation voltage generation circuits;

nodes each existing on each circuit connecting each of the power supply circuits and each of the ends; and a connection line which connects the nodes to each other, the power supply circuit provided on the master driver supplying a reference voltage to all the ends, the gradation voltage generation circuits generating gradation voltages based on the reference voltage, wherein each of the signal line drivers comprises an output switching circuit arranged on a circuit connecting the power supply circuit and the node to control supply of a voltage from the power supply circuit to the node, an off state of the output switching circuit provided on the master driver is changed to an on state after an output of the power supply circuit has been made stable, and the reference voltage supplied to the end of the master driver through the output switching circuit is supplied to all the ends through the connection line.

10. The display device of claim 9, wherein the display panel includes:

signal lines connected to the signal line drivers and arranged parallel to the display area; and scanning lines arranged parallel to the display area to intersect the signal lines, and the connection line is formed of a same material in a same layer as the signal lines or the scanning lines.

11. The display device of claim 9, wherein each of the signal line drivers comprises a diode connected parallel to the output switching circuit and connected in a forward direction from the power supply circuit toward the end.

12. The display device of claim 9, wherein all the signal line drivers have a same circuit configuration.

13. The display device of claim 9, wherein a drive frequency of the display panel is equal to or higher than 120 Hz.

* * * * *